US007331393B1

(12) United States Patent
Hoel

(10) Patent No.: US 7,331,393 B1
(45) Date of Patent: Feb. 19, 2008

(54) SUBSEA LUBRICATOR DEVICE AND METHODS OF CIRCULATING FLUIDS IN A SUBSEA LUBRICATOR

(75) Inventor: Karl-Willie Hoel, Heggedal (NO)

(73) Assignee: FMC Technologies, Inc., Houston, TX (US)

( * ) Notice: Subject to any disclaimer, the term of this patent is extended or adjusted under 35 U.S.C. 154(b) by 647 days.

(21) Appl. No.: 10/089,751

(22) PCT Filed: Sep. 28, 2000

(86) PCT No.: PCT/NO00/00318

§ 371 (c)(1),
(2), (4) Date: Jul. 31, 2002

(87) PCT Pub. No.: WO01/25593

PCT Pub. Date: Apr. 12, 2001

(30) Foreign Application Priority Data

Oct. 1, 1999 (NO) ..... 19994784

(51) Int. Cl.
*E21B 29/12* (2006.01)

(52) U.S. Cl. ..... 166/336; 166/86.2; 166/250.01

(58) Field of Classification Search ..... 166/336, 166/337, 368, 86.2, 250.01
See application file for complete search history.

(56) References Cited

U.S. PATENT DOCUMENTS 2,670,225 A 2/1954 McKinney
3,638,722 A 2/1972 Talley, Jr.
3,712,862 A * 1/1973 Hainebach ..... 507/238
4,658,904 A * 4/1987 Doremus et al. ..... 166/336
4,705,114 A * 11/1987 Schroeder et al. ..... 166/357
4,836,289 A 6/1989 Young
4,993,492 A 2/1991 Cressey et al.
5,819,582 A * 10/1998 Kelly ..... 73/290 R
6,102,125 A * 8/2000 Calder ..... 166/359
6,360,822 B1 * 3/2002 Robertson ..... 166/368

FOREIGN PATENT DOCUMENTS

GB 1594714 8/1981
GB 2184762 A 7/1987
GB 2214954 A 9/1989
GB 2233365 A 9/1991
WO WO 93/03254 * 2/1993

* cited by examiner

*Primary Examiner*—Thomas A Beach
(74) *Attorney, Agent, or Firm*—Williams, Morgan & Amerson, P.C.

(57) ABSTRACT

Subsea lubricator device, comprising a blowout preventer assembly, a tool housing assembly and a stuffing box, intended to be located at a subsea Christmas tree, and methods of circulating fluids in a subsea lubricator. The device comprises a blowout preventer (40) and a lubricator (60). Along the entire length of the device a bypass (46, 66) is located. The bypass communicates fluid with the device via a fluid connection (72) at the upper end of the tool housing and via a valve assembly (51) at the bottom of the blowout preventer. This permits removal of gas or oil being present in the device by circulating the hydrocarbons in the well.

40 Claims, 18 Drawing Sheets

SECTION B – B

SECTION B-B

SECTION B – B

SECTION A – A

SUBSEA LUBRICATOR DEVICE AND METHODS OF CIRCULATING FLUIDS IN A SUBSEA LUBRICATOR

CROSS-REFERENCE TO RELATED APPLICATION

This application claims priority of International application number PCT/NO00/00318, filed Sep. 28, 2000, which in turn claims priority of Norwegian application number 19994784, filed Oct. 1, 1999.

FIELD OF THE INVENTION

The invention relates to a subsea lubricator device, comprising a blowout preventer assembly, a tool housing assembly and a stuffing box, intended to be located at a subsea Christmas tree.

Moreover, the invention relates to methods of circulating fluids in a subsea lubricator.

BACKGROUND OF THE INVENTION

Works are performed in an oil or gas well, among others, to stimulate or treat the well to increase production, to replace various equipment such as valves, to make measurements, to monitor the state of the well, or anything else being required.

Treatment of the well, for increasing the production rate or volume, is made after a cost/benefit evaluation. Even if the production from a well may be increased by several factors, the intervention costs may become to high or the work considered being to difficult and time consuming. For onshore or platform wells, having easy access into the Christmas tree and infrastructure in the form of lifting equipment etc., the costs of performing the well intervention will be less relatively to the benefit of the operations. The intervention of subsea wells is much more expensive. A vessel (drilling rig or the like) has to be used, involving large daily expenses and, in addition, time consuming transit to and from the field, and large costs as the work requires much more time. Because of this, the production volume from a platform or onshore well is also up to twice the volume of a subsea well with similar reservoir conditions. As mentioned above this is caused by the more easy access making a better programme for well maintenance practically possible and profitable.

Well intervention may be difficult, as existing barriers have to be removed before entering the well. There are strict rules regarding which measures being required to prevent an uncontrolled blowout during such works. Thus, when well intervention shall be performed, a pressure barrier has be established in the form of a blowout preventer. This may vary from simple stop valves to large drilling BOPs. In addition, circulating fluids in the well may be needed, whereby possible pressure increase in the well may be controlled.

PRIOR ART

There are two main categories of intervention systems

1. When there is a need to perform circulation, as during stimulation of the well (chemical treatment or fracturing), a pipe string is used, for instance a coiled tubing. In addition, a closed fluid passage, in the form of a riser, has to be established between the well and the platform in subsea wells. A subsea blowout preventer is secured at the riser and lowered from the rig and fastened at the top of the Christmas tree. A second pressure control assembly (for intervention) is located at the top of the riser, i.e. at the platform. A coiled tubing injector is located at the pressure control assembly by means of coiled tubing. Moreover, this comprises a sealing device, in the form of a stuffing box or the like, and the coiled tubing is sealingly led therethrough. Thus, the equipment and the tool may be lowered in the well under controlled conditions.
2. When there is no need of circulation, i.e. during simple measurements, or when equipment shall be retrieved/located by means of a wire, a smooth slick line, or a cable suspending an instrument, or a tool. A grease injector head (or stuffing box) is arranged to engage sealingly around the wire, whereby the tool may be run downwardly in the well without escape of oil or gas from the well, and whereby a pressure-proof barrier is ensured. During use of a wire this pressure-proof barrier is achieved by means of a lubricant being continuously injected under pressure into the grease injector head, thereby the name lubricator.

From U.S. Pat. No. 4,993,492 is known a kind of lubricator for use at a subsea well. The lubricator is located at the top of the riser, in the same manner as discussed above. Through this a tool may be lowered in the well, suspended by the wire, for performing operations.

From U.S. Pat. No. 3,638,722 is known a subsea lubricator located directly on the Christmas tree at the sea bottom. In this manner the use of a riser is avoided and expenses for installation of the riser are saved. In addition, smaller and more inexpensive vessels may be used. Use of wire instead of pipe string during lowering of equipment in the well involves several advantages, particularly lower weight, more easily handling of equipment and less expenses.

As disclosed by the patent above a subsea lubricator consists of a first, or lower assembly in the form of a blowout preventer, including valves for controlling the well pressure, cutting of wire, etc, a second component located above this and comprising of a tool housing with associated equipment, and uppermost a grease injector head (or stuffing box, depending on the kind of wire being used). The latter comprises devices for supply of grease under pressure into the grease injector head. This both lubricates the wire, whereby it slides more easily therethrough, and provides sealing between the wire and the gate, whereby possible well fluids may not be discharged into the environment. The tool housing has a length corresponding to approximately the length of the tool suspended at the end of the wire, normally 15-25 meters. During replacement of a tool all of the grease injector head, with the tool, are withdrawn upwardly to the surface.

Such a lubricator may not be used for circulation in the well. Another disadvantage is the practical problems of being able to circulate out unwanted fluids entering the lubricator. Hydrocarbons, or other contaminating fluids entering the lubricator during the work may not be discharged into the surroundings, from environmental reasons. Thus, in practice such fluids are removed from the lubricator by means of a special return line being able to convey the fluid upwardly into the vessel at the surface. However, this means that the vessel must have equipment for treatment of the fluids, i.e. hydrocarbons, in a proper way, which means increasing costs (larger vessel, etc.).

SUMMARY OF THE INVENTION

The present invention relates to an improvement of a subsea lubricator, and methods of circulating out fluids from such a lubricator.

An object of the invention is to provide a lubricator being less heavy and less expensive, and a method of more easily circulating fluids therefrom for well intervention.

A second object of the invention is to provide a subsea lubricator comprising means for circulating the well.

A third object of the invention is to provide means, permitting unwanted fluids in the tool to be circulated back into the well instead of to the vessel.

An additional object of the invention is to provide a subsea lubricator which may be used at large depths.

An important aspect of the invention is to avoid formation of hydrates caused by water contacting hydrocarbones.

This is obtained by a lubricator comprising at least one bypass, whereby fluids may be circulated back to the well, or into a flow line. Moreover, it is advantageous that the circulation may occur from different levels of the lubricator, and also that the bypasses may be opened/closed independently of one another.

BRIEF DESCRIPTION OF THE DRAWINGS

The invention shall hereinafter be described by means of examples, referring to the accompanying drawings, wherein.

DESCRIPTION OF EMBODIMENTS

Figure 1:
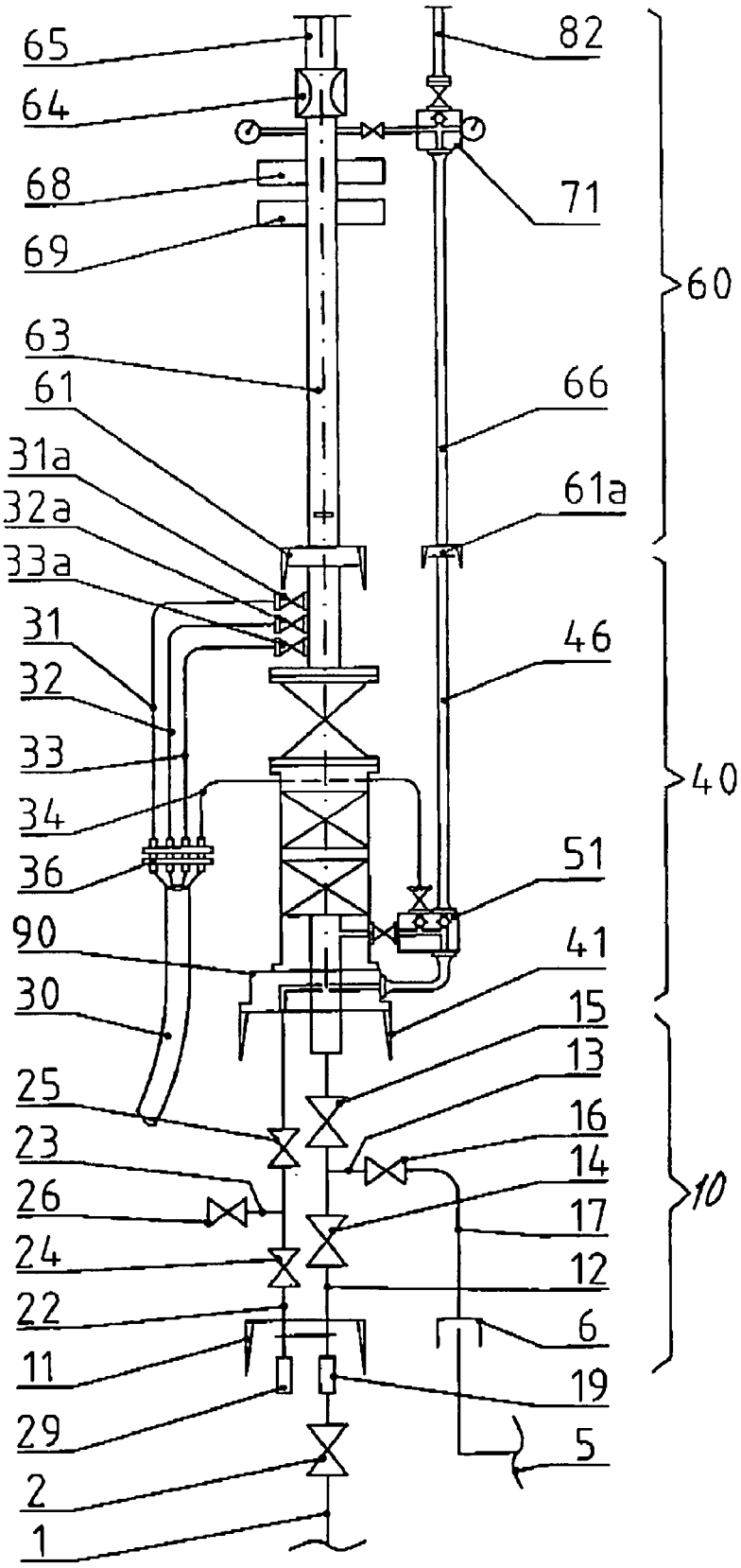
FIG. 1 is a diagrammatic sketch showing the components of the system.

In FIG. 1 the components of a subsea lubricator arranged to be located at a conventional Christmas tree are shown diagrammatically. The lubricator consists of three main components, a pressure control assembly (blowout preventer) 40 which comprises valves controlling the well during the intervention operation. A tool housing assembly 60 comprises a tubular column for a tool which shall be run downwardly in the well. At the top of the tool housing a stuffing box, or a grease injector head 64 is located for slidable but sealed leadthrough of the cable, or wire suspending the tool. All the three components are connected to one another by means of connector devices. In addition, components of the Christmas tree and the well are shown diagrammatically.

In addition, all of the components comprise various equipment for guiding, monitoring etc. known within the art and, therefore, not further discussed here. The well is completed by a tubing 1 having a downhole safety valve 2, in accordance with standard practice. The tubing defines an annulus (not shown) between itself and the well casing. A valve (not shown) may be installed in the tubing, permitting fluid communication between the interior of the tubing and the annulus downwards in the well.

The Christmas tree 10 is of a usual type well known by the skilled person and, therefore, only its main features will be described. The production passage 12 of the Christmas tree has a production master valve 14 and a production swab valve 15. An outlet 13, having a production wing valve 16, is located between these. The outlet 13 communicates with a conduit 17 ending in a connector 6 for a flow line 5 extending to a manifold, or to a production vessel. The annulus passage 22 of the Christmas tree has the same type of valves, namely an annulus master valve 24, an annulus swab valve 25, and an annulus wing valve 26. The annulus wing valve is located in a lateral outlet 23 and used for control of a possible overpressure in the well annulus. The outlet 23 may communicate with the pipe 17 through a crossover (not shown).

The Christmas tree is connected to the wellhead using a standard wellhead connector 11. This may for instance be of a type comprising a dual completion, where the passage 12 communicates with the tubing 1, and the annulus passage 22 communicates with the well annulus. It is connected sealingly to a tubing hanger in the wellhead. This enables fluid to be circulated downwardly in the well through the tubing and upwardly through the annulus, or vice versa.

Profiles 19, respectively 29, are machined in the tubing hanger, into which plugs may be inserted to close the well.

During normal production the top of the Christmas tree 10 is closed by a removable cap (not shown). This functions as a secondary barrier (in addition to the valve 15), this being required as a supplementary protection against discharge of oil or gas into the environment. The cap will also prevent water from penetrating into the Christmas tree. This is removed when work is to be performed in the well. The cap is provided with conduits extending therethrough for the supply of hydraulic fluid to the valves in the Christmas tree. Therefore, when the cap is removed, the hydraulic connection is broken. This is done intentionally, as in this manner it is ensured that all of the valves in the Christmas tree are; or will be closed, nor can be opened from the control room at the production platform after the cap has been removed. This is very important as the valves have to be closed when the cap is removed, before attachment of the pressure control device 40 to the Christmas tree.

Figure 23:
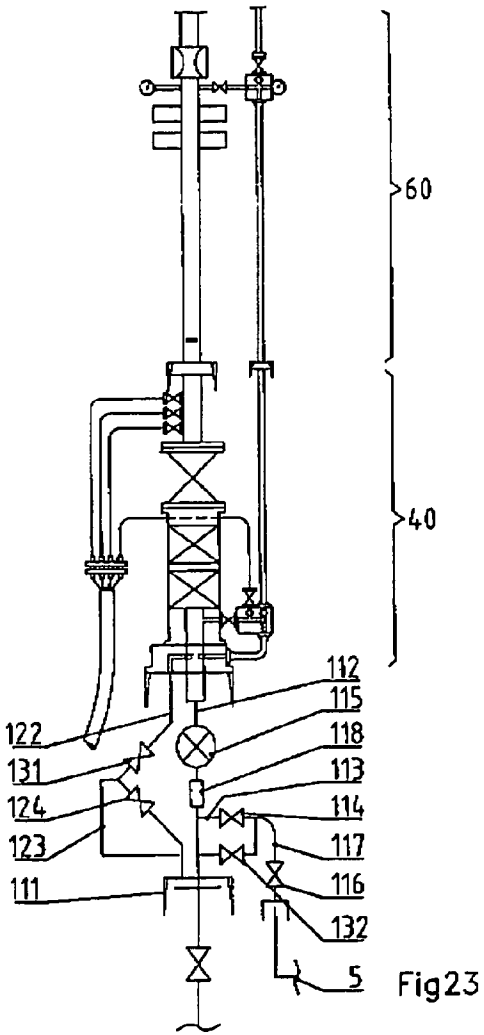
FIG. 23 is diagrammatic sketch similar to FIG. 1, showing the invention used with a horizontal Christmas tree having a ball valve and a plug.

FIG. 23 is a sketch corresponding to FIG. 1, showing the lubricator installed on a horizontal Christmas tree (HXT), indicated generally by the numeral 100, having a ball valve and a plug as the two barriers. The Christmas tree is of known construction and will hereinafter be described only to show the differences between this and the conventional Christmas tree. In the drawings components having functions corresponding to components in the conventional Christmas tree have been given corresponding reference numerals, with the addition of 100. Similar components have the same reference numerals.

Besides, it shall be noted that an important difference between a conventional and a horizontal Christmas tree is that in the conventional Christmas tree the tubing is suspended at the wellhead itself, while in a horizontal Christmas tree it is suspended within the Christmas tree. Thus, the annulus extends all through and within the Christmas tree. In a horizontal Christmas tree another important difference is that the master valve is arranged at the side outlet Moreover, the supply of hydraulic fluid enters via a control module in a horizontal Christmas tree, and not through the tree cap.

Correspondingly as the conventional Christmas tree, the horizontal Christmas tree has a production passage 112 and an outlet 113. A master valve 114 and a wing valve 116 are located in the outlet 113.

In accordance with regulations a double barrier shall always be established in the Christmas tree, in order to safeguard against discharges from the well. As mentioned above, in the conventional Christmas tree this is provided by the valve 15 and the cap, as described above. In a Christmas tree of this type the barriers consist of the ball valve 115 and the plug 118. The ball valve is located in an internal tree cap having the same function as the tree cap, discussed previously in connection with the conventional Christmas tree, but arranged, as its name implies, within the upper part of the Christmas tree. The plug is located in a machined profile in the tubing hanger passage.

Correspondingly, a master valve 124 and a workover valve 131 are located in a lateral passage 122 of the Christmas tree. A bypass 123, called a "crossover", connects the lateral passage with the outlet 117 from the production passage, controlling possible overpressure in the well annulus. In this "crossover" a stop valve 132 is located.

Figure 24:
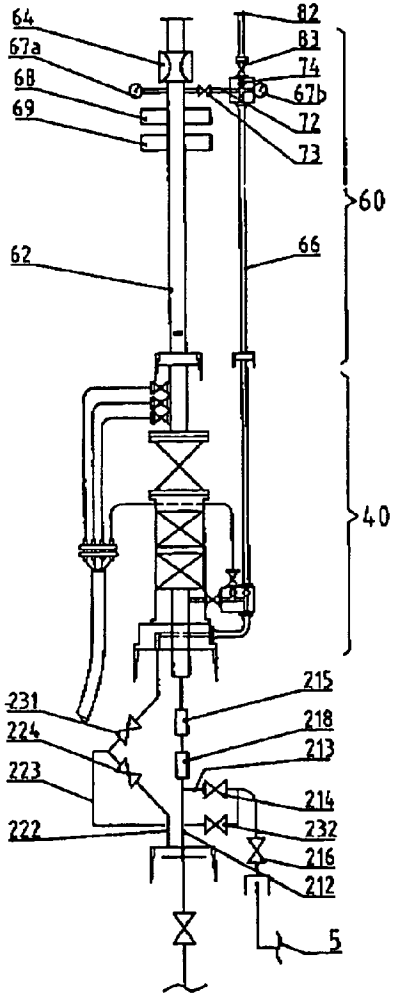
FIG. 24 is a diagrammatic sketch similar to FIG. 1, showing the invention used with a horizontal type Christmas tree having two plugs.
Figure 26:
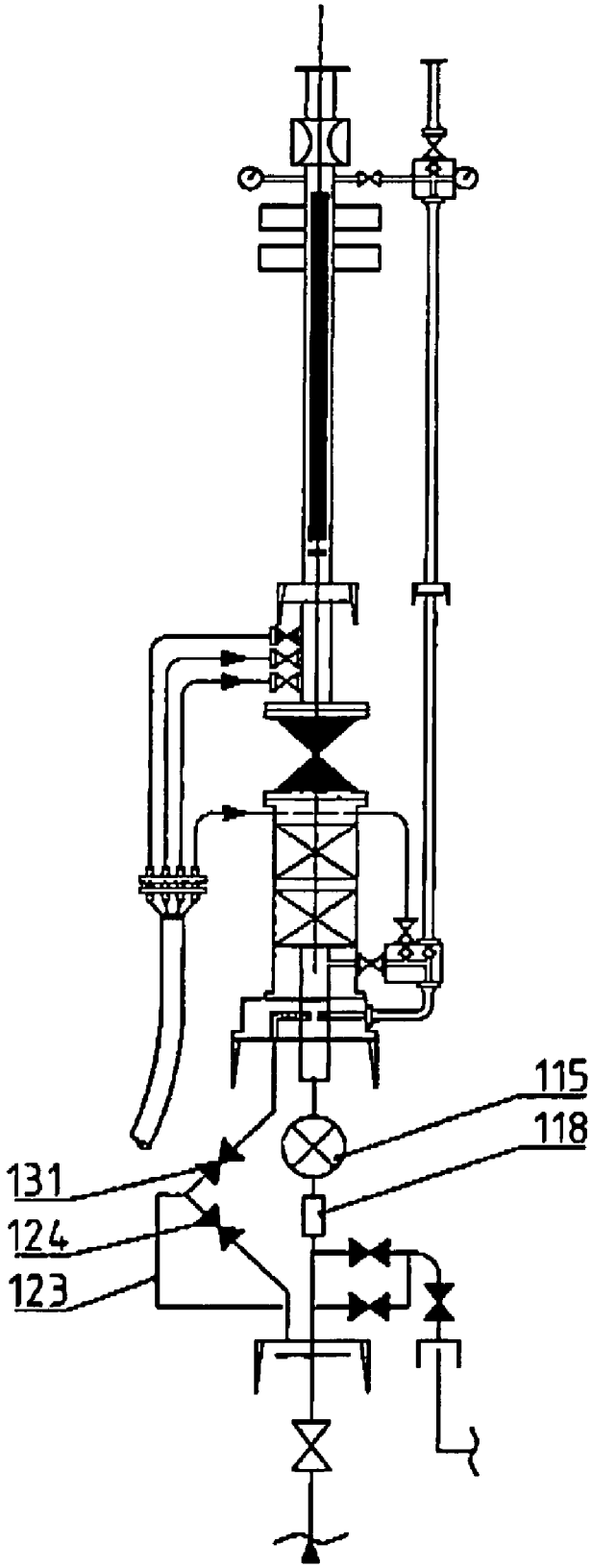

FIG. 24 is a diagrammatical sketch corresponding to FIG. 23, wherein the Christmas tree is a horizontal Christmas tree (HXT), indicated generally by the reference numeral 200, having crown plug. This means that the ball valve has been replaced by a plug located in the internal tree cap. Otherwise, this Christmas tree is identical to the one discussed above. In the drawing components corresponding to components of the conventional Christmas tree have been given the same reference numerals as in FIG. 1 but with the addition of 200. Similar components have the same reference numerals.

The crown plug 215, replacing the ball valve, is located in the internal tree cap, while the second plug 218 is located in the tubing hanger.

When the well is producing, the master valve 14 (114, 214) and the wing valve 16 (116, 216) are kept open, whereby the well fluids are directed into the outlet 13 and the flow line 5. Normally, all the other valves in the Christmas tree are closed.

In the following the pressure control assembly 40 shall be described, referring to FIG. 1, and FIGS. 3-6.

The pressure control or blowout preventer assembly includes in general a number of valves which ensure control of the well during intervention. Particularly, this component has been developed for use in the present invention and, thus, will hereinafter be referred to as a LIP-assembly ("Lower Intervention Package").

The LIP-assembly includes a number of valves, controlling the well during intervention. These may for instance be (seen from the bottom upwardly) a pipe ram 43, i.e. a valve being able to grip around a cable, or a wire, preventing the tool from falling downwardly in the well, if the wire suspending the tool has to be cut. Further there are a shear ram 44 and a blind ram (gate valve) 45. It shall be noted that additional such valves may be present and arranged in another orders than the one discussed above.

The lower part of the LIP-assembly comprises connector means 41 for attachment at the upper part of the Christmas tree. In a preferred embodiment the connector means 41 is part of an adapter 90 comprising, among others, the connector means 41 mentioned above in addition to connector devices, securing the adapter to the LIP-assembly. This means that the lubricator may be easily adapted for use with connector profiles in various types of Christmas trees. In addition, the adapter may have other functions which will be described later.

Figure 6:
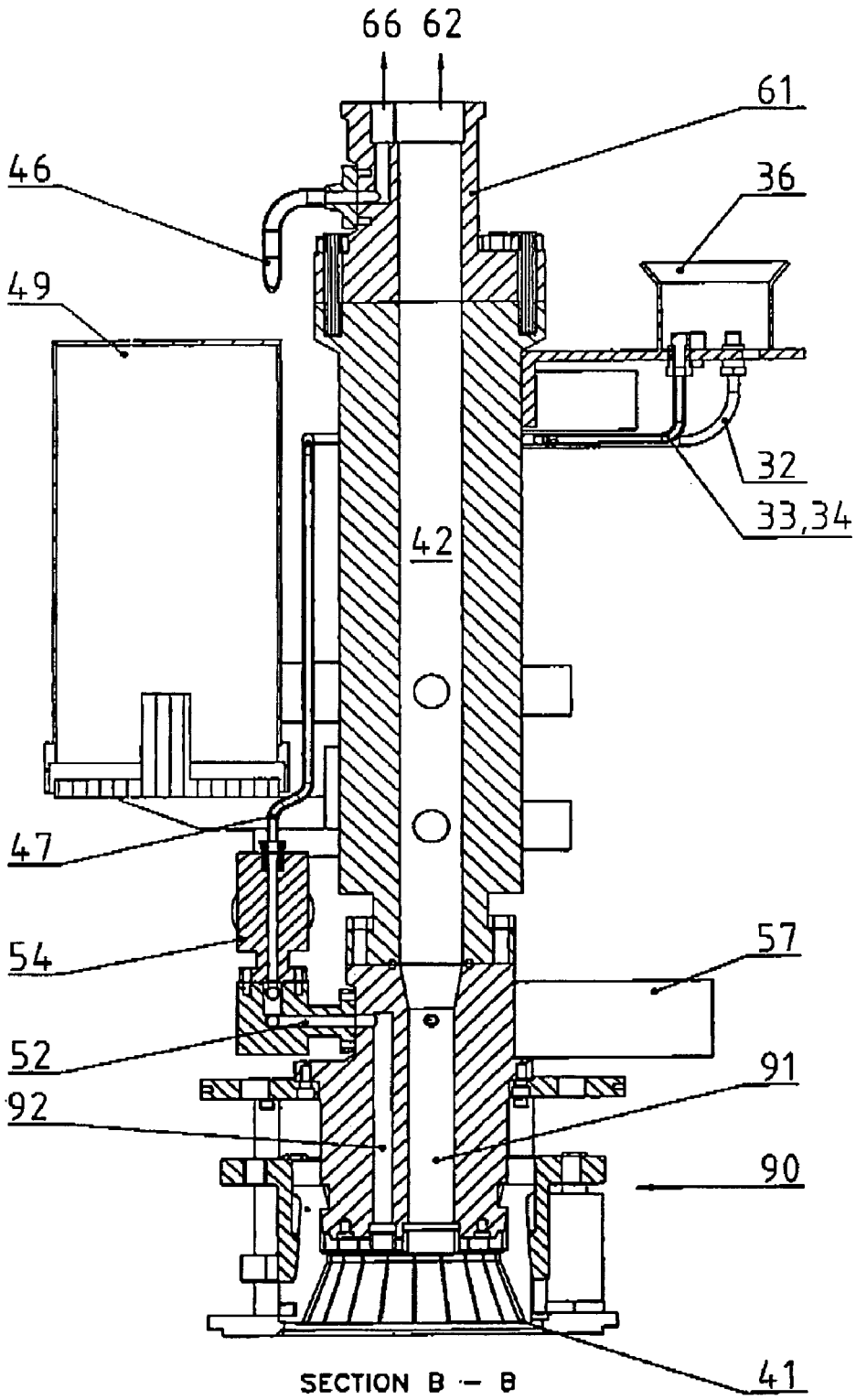
FIG. 6 is a vertical section of the pressure control assembly along the line A-A in FIG. 3.

The adapter comprises passages 91, 92, as shown in FIG. 6, communicating with the production passage 12 and the annulus passage 22 in the Christmas tree, respectively. Moreover, the passage 91 communicates with a passage 42 in the LIP-assembly. The passages 42, 91 and 12 have coincident axes, i.e. they extend in-line with one another. Moreover, the adapter comprises passages (not shown) for supply of hydraulic fluid into the valves in the Christmas tree, whereby these may be opened and closed during the intervention process. These are communicating with hydraulic lines (not shown) in an umbilical 30 and are controlled by a control module 49. The valves in the Christmas tree may be opened and closed in this manner during the intervention process.

An additional passage, or bypass 46 is located in the LIP-assembly. In a preferred embodiment the bypass is formed as a separate pipe connected removably to the side of the LIP-assembly, as shown in FIG. 1. The bypass 46 provides a fluid passage around the valves in the LIP-assembly. In the embodiment shown in FIGS. 3-6 the lowermost of the bypass is inserted into the adapter 90.

Alternatively, the bypass 46 may be formed as a passage in the LIP-assembly.

A first valve assembly, indicated generally by 51 in FIG. 1, is located in connection with the LIP-assembly In a preferred embodiment the valve assembly consists of a number of valves, conduit pieces etc., forming an assembly fastened to the adapter 90.

However, the skilled person will realize that this may be formed in many ways. The valve assembly may for instance be a part of the adapter.

Figure 4:
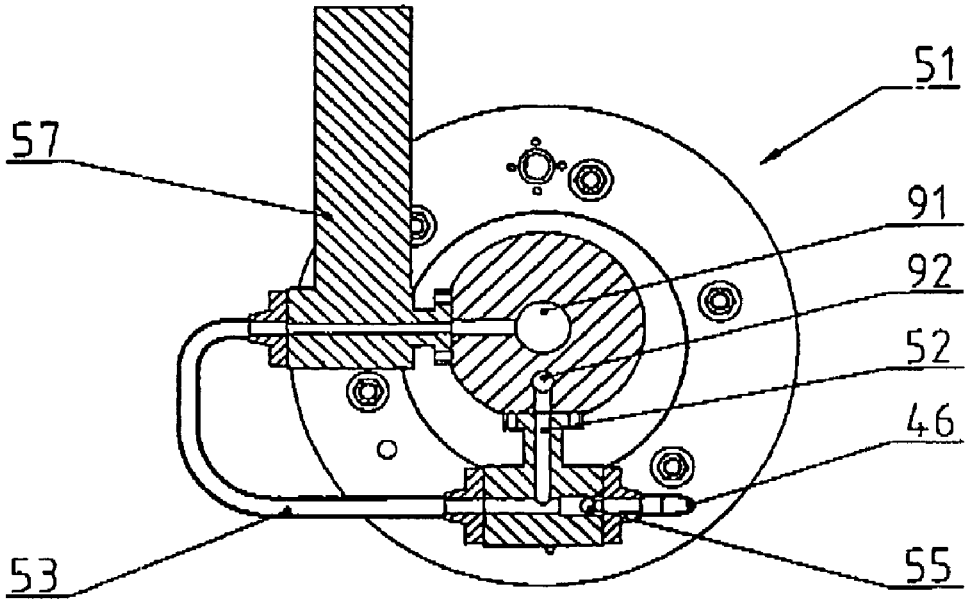
FIG. 4 is a horizontal section along the line C2-C2 in FIG. 3.
Figure 5:
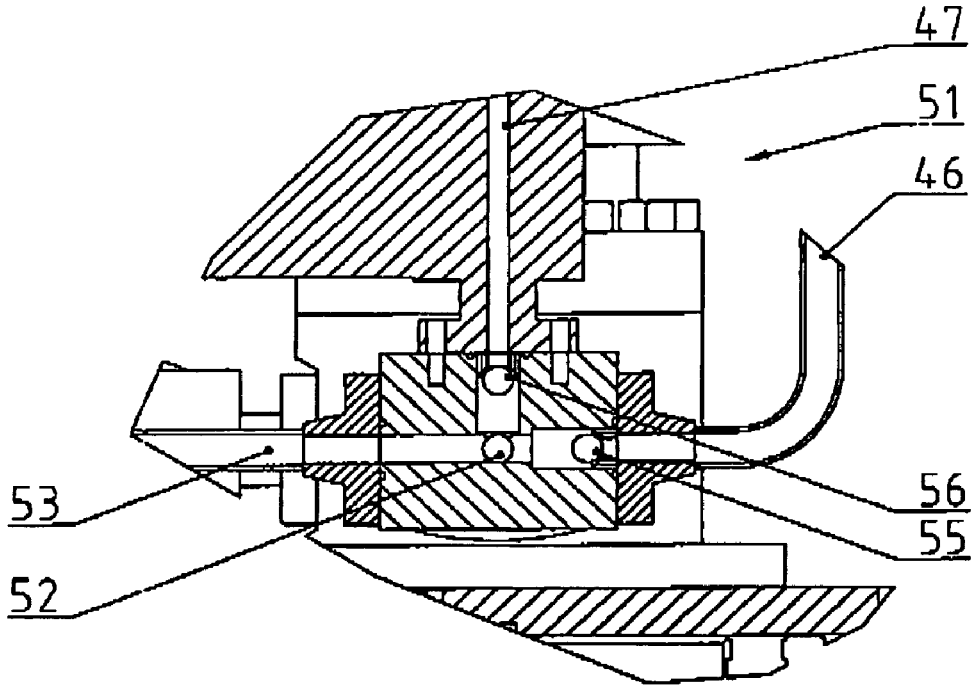
FIG. 5 is a vertical section showing a detail along the line C1-C1 in FIG. 3.

The components of the valve assembly are shown more detailed in FIGS. 4 and 5. It comprises two inlets communicating with the bypass 46 and a fluid supply line 47, respectively. Check valves 55 and 56 may be located in the inlets, enabling fluid to flow only into the valve body. Further, two outlets, namely a first outlet 53 communicating with the main passage 91 in the adapter (and, thereby, the production passage 12 of the well), and a second outlet which via a passage 52 provide fluid communication into the second passage 92 in the adapter communicating with the annulus passage 22 of the Christmas tree. A stop valve 57 is located in the inlet 47. Likewise, a stop valve 57 is located in the outlet 53. By this combination of valves and passages various forms of well circulation may be performed which will be described more detailed later.

The upper part 60 of the lubricator comprises a tool housing 63 for receipt of a tool which shall be inserted in the well. This is secured removably to the LIP assembly by connecting means 61, whereby the passage 62 in the tool housing is in axial extension of the passage 42 (FIG. 6).

As an additional safeguard shear and support rams 68, 69 may be placed at the upper part of the tool housing.

The lubricator may comprise meters and other equipment monitoring the work. In FIG. 1 two pressure meters 67*a*, 67*b* are indicated diagrammatically.

The tool housing assembly 63 also comprises a bypass 66, correspondingly as the LIP-assembly. The bypass 66 communicates with the bypass 46. As indicated diagrammatically in FIG. 1 the bypass 66 may be a pipe being removably secured to the side of the tool housing. If so, the bypass 66 has to comprise connector means 61*a*, as shown diagrammatically in FIG. 1. Alternatively, the bypass may be formed as a part of a multi-passage tool housing.

When the bypasses 46, 66 are separate components, these are advantageously flexible hoses.

At the upper part of the tool housing assembly a fluid connection 72 is arranged between the tool housing 63 and the bypass 66. In FIG. 1 this is shown diagrammatically as a crossover 72. The fluid flow from the tool housing into the bypass pipe may be closed by means of a valve 73 arranged in the crossover 72. A second inlet is shown as a pipe stub 82 having connector means for attachment to an external fluid supply. The purpose of this will be explained more detailed later. A stop valve 74 is located in the passage 82.

At the top of the tool housing a stuffing box 64 and a pipe stub 65 are arranged which may comprise a connector profile and, possibly, an insertion tunnel facilitating insertion of the tool to be lowered downwardly in the well.

In practice the stuffing box is secured removably to the tool housing 63. This provides the possibility to choose whether the stuffing box shall be situated at the tool housing all the time, and adapted to be opened, whereby the tool may be led therethrough, or lowered downwardly (and withdrawn upwardly) with the tool.

Figure 9:
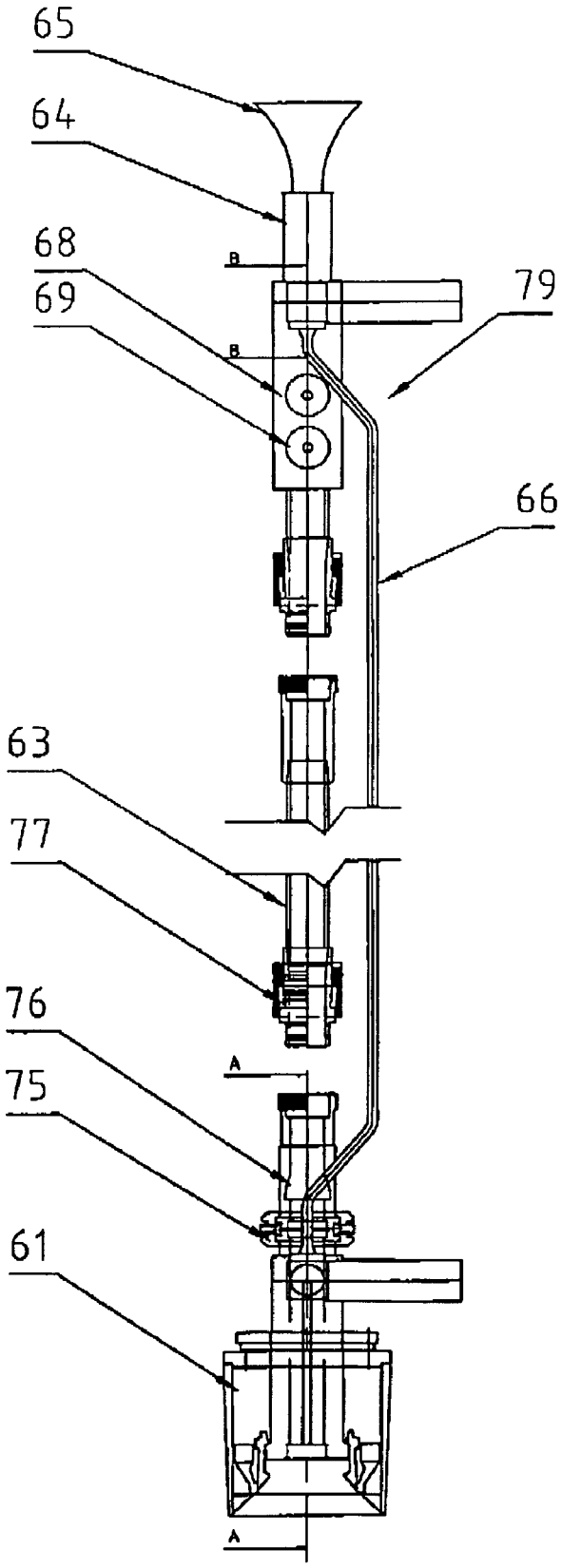
FIG. 9 is an elevational view showing the tool housing assembly.
Figure 10:
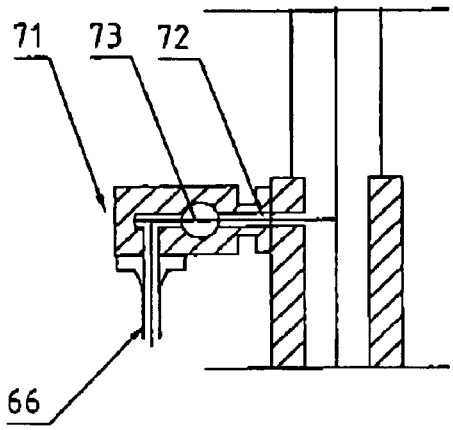
FIG. 10 is a vertical section along the line B-B in FIG. 9.
Figure 11:
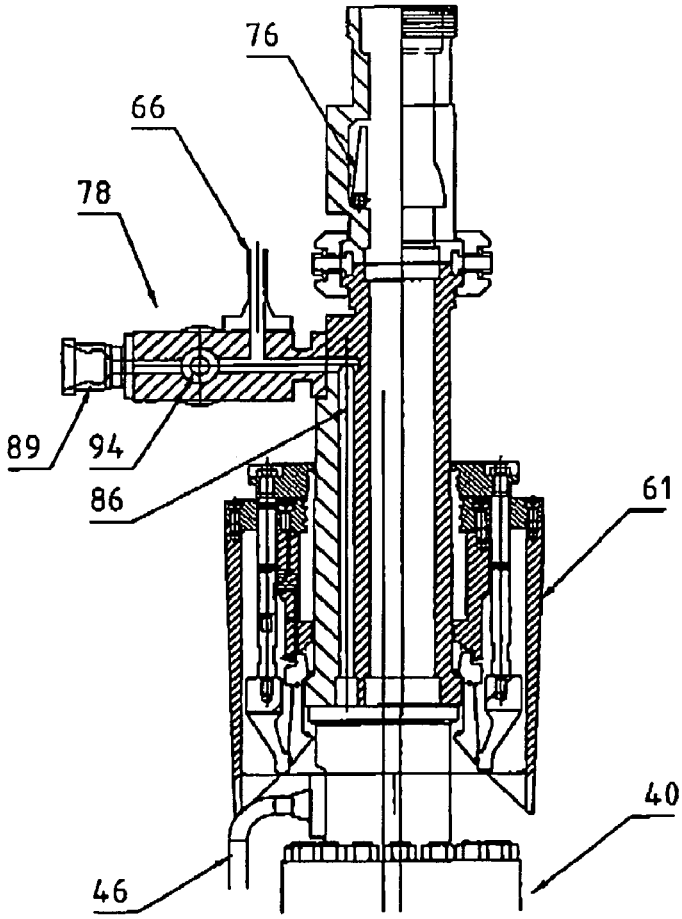
FIG. 11 is a vertical section along the line A-A in FIG. 9, FIGS. 12-16 are diagrammatic sketches showing a first method of circulating.
Figure 13:
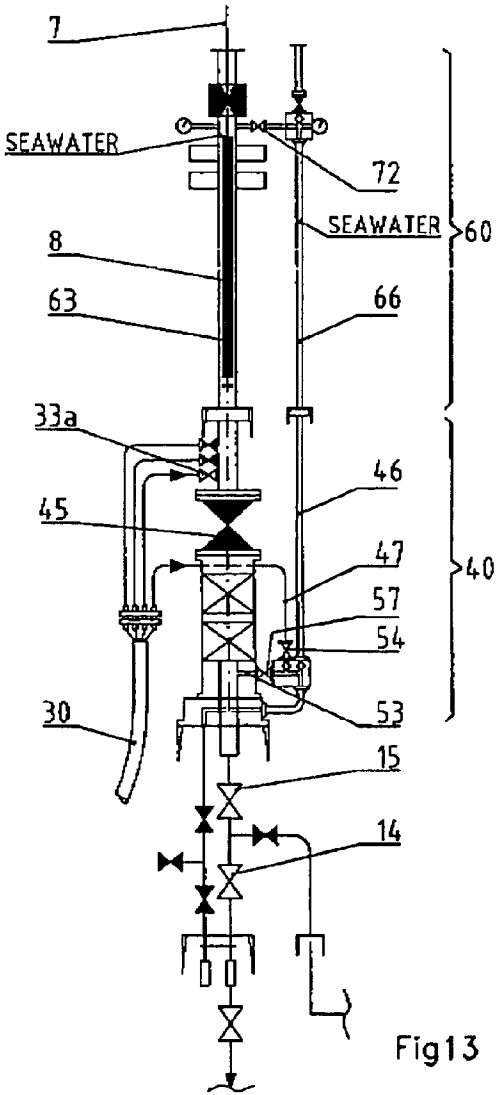
Figure 12:
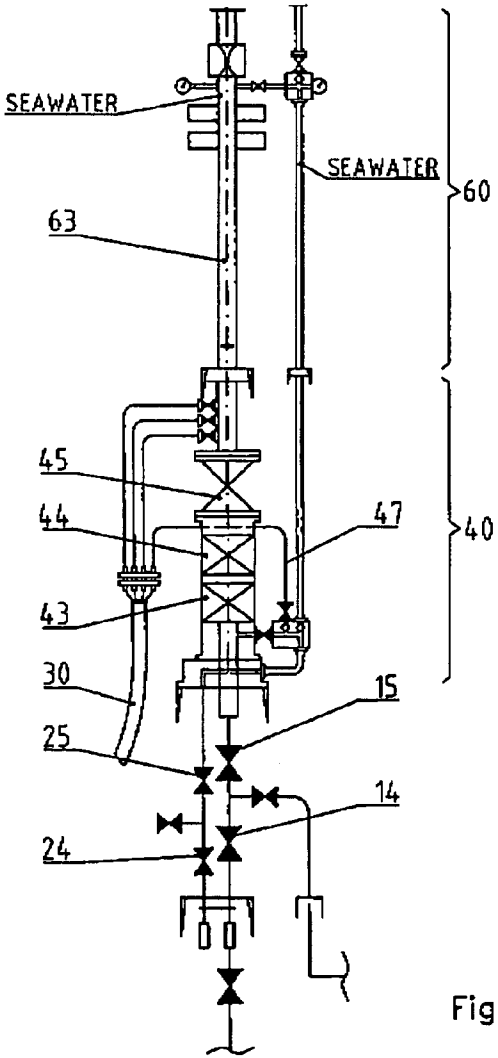

Now, a practical embodiment of the upper part 66 of the lubricator shall be described, referring to FIGS. 9-11.

Normally, the tool housing will be made up of a number of pipes screwed together for a length of about 15 meters, enabling receipt of standard types of tools being used during intervention. The tool housing has connector devices at its ends.

A lower sub 75 provides transition between the tool housing and the LIP-assembly. The sub 75 comprises upper connector means 77 for attachment to the tool housing, and lower connector means for attachment to the upper connector 61 of the LIP-assembly. This is shown in FIG. 11, indicating the LIP-assembly by broken lines. The sub may include a tool trap 76, shown as a flap valve, which may be closed in order to prevent the tool from falling down in the well.

The sub comprises a passage 86 providing fluid communication between the passage in the bypass 66 and a passage in the LIP-assembly (FIG. 6) communicating with the bypass 46.

The lower sub 75 may include a lower crossover piece 78 comprising an inlet for the bypass 66, and an additional inlet 89 for an external fluid supply. A stop valve is located in the inlet 89.

A upper sub 79 is connected removably to the top of the tool housing, and comprises the control valves 68, 69 mentioned above, and a housing for insertion of the stuffing box 64. Uppermost the sub ends in a pipe stub 65, possibly having an insertion hopper facilitating insertion of the tool into the tool housing.

An upper crossover piece 71 (FIG. 10) is secured to the sub 79. The crossover piece 71 has a passage 72, communicating with the passage 62 of the tool housing and the passage 66 of the bypass. The bypass 66 is secured at the crossover piece 79. A valve 73 is located in the passage 72.

Again, it shall be referred to FIG. 1. An umbilical 30 extends from the surface to the lubricator. This comprises lines for supply of hydraulic fluid and electricity, controlling the valves in the Christmas tree (as per standard practice). In addition, lines for supply of chemical fluids, in the drawings shown, by way of an example, as a supply line 31 for a diluent such as diesel, a line 32 for water, and two lines for a hydrate inhibiting fluid. The connection between the umbilical and the lubricator is shown at 36. Stop valves 31*a*-33*a* are located for the respective passages 31-33, controlling the supply of the various fluids. The line 34 is connected to the passage 47 having the stop valve 54. In this manner the fluids mentioned above may be supplied to the apparatus, and particularly into the tool housing 51. In addition, check valves may also be located in the passages 31-34, increasing the safeguard against discharges if the umbilical should be disconnected by an accident.

A control module 49 (FIG. 3) may be located at the LIP-assembly, controlling the various functions during the use of the lubricator.

Figure 2A:
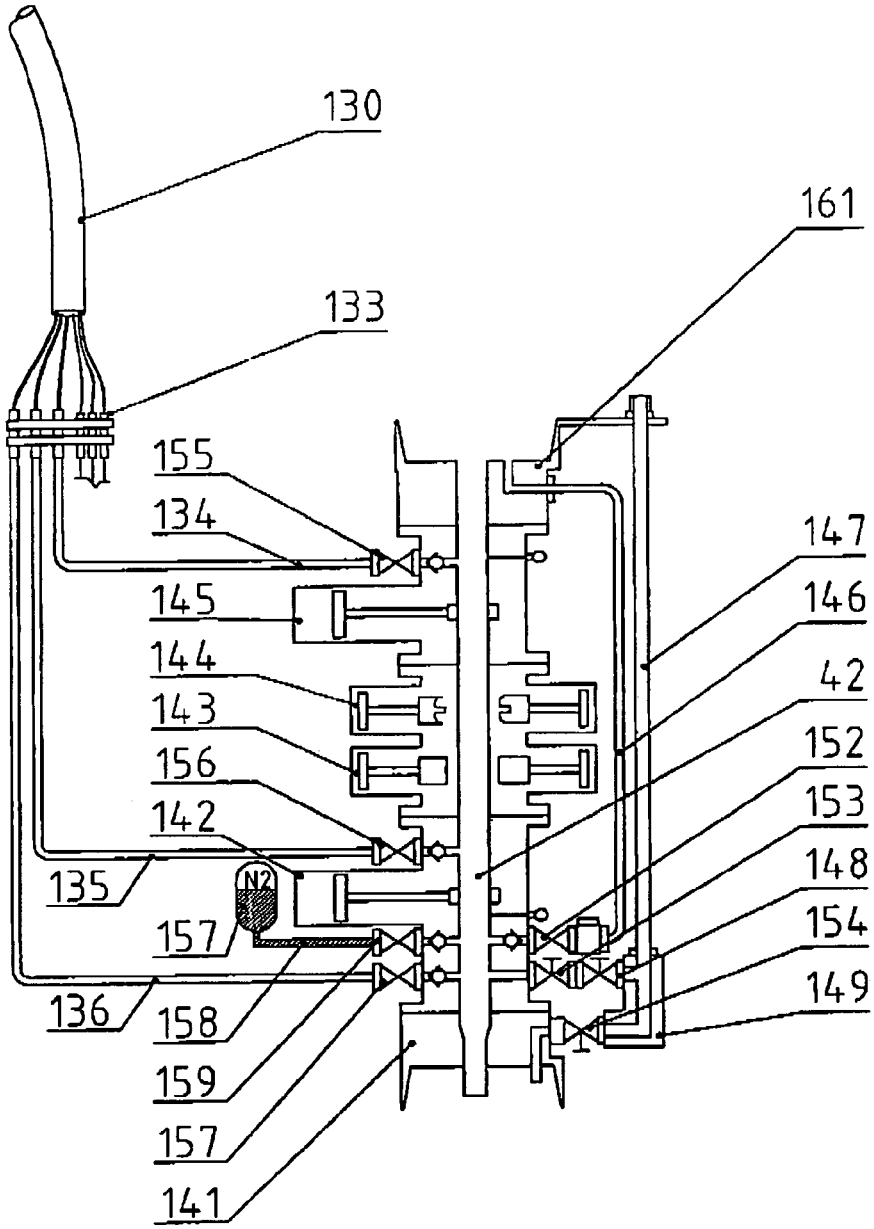
FIGS. 2*a*-2*b* are drawings corresponding to FIG. 1, of a second embodiment of the system components, and FIG. 2*b* being in extension of FIG. 2*a*.
Figure 2B:
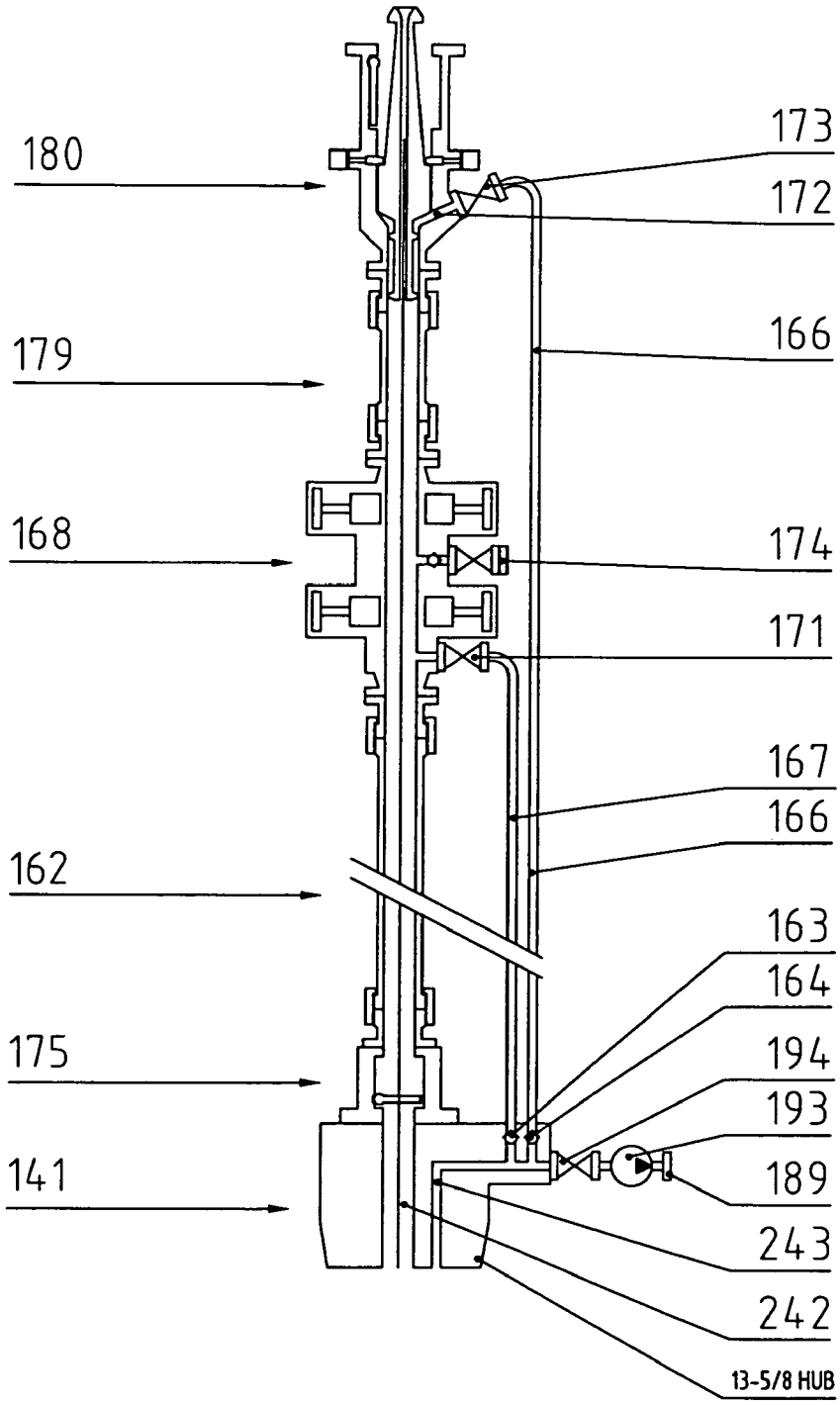
Figure 3:
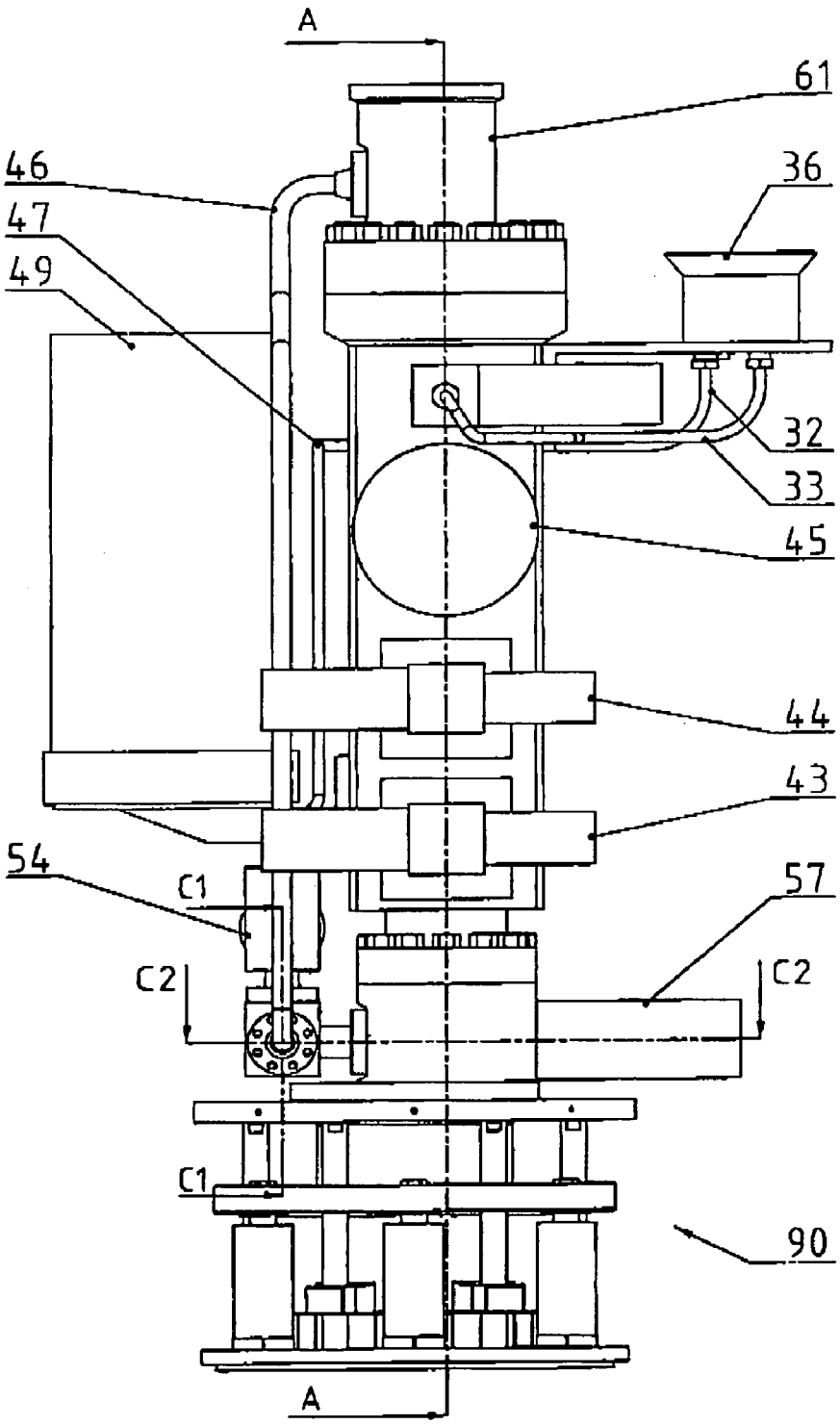
FIG. 3 is an elevational view showing the pressure control assembly.

Now, it shall be referred to FIG. 2 showing a second embodiment of the invention. FIG. 2*a* shows the lower part of the lubricator (the pressure control assembly) and FIG. 2*b* shows the upper part with the tool housing.

A pressure control assembly 140 comprises a lower connector 141 for attachment to a Christmas tree, and an upper connector 161 for attachment to a corresponding connector at the tool housing assembly (FIG. 2*a*). The assembly consists of the following valves, mentioned from below: a lower blind ram (gate valve) 142, a pipe ram 143, a shear ram 144, and a upper stop valve 145

A passage 42 extends axially in the pressure control device in the same manner as discussed above A first bypass 146 is arranged in a manner providing a fluid passage around the valves mentioned above. In FIG. 2*a* the bypass is shown as a pipe being connected to the connector 161 at its upper end, and communicating with the passage 42 of the LIP-assembly via a passage at its lower end. A stop valve is located in the bypass.

A second bypass 147 is arranged in a manner providing a fluid passage into the lower end of the LIP-assembly. As shown the bypass 147 ends in two branches 148, 149 communicating with the passage 42 of the LIP-assembly and the annulus passage 22 of the Christmas tree, respectively (FIG. 1). Stop valves 153, 154 are located in the branch passages 148, respectively 149. At its upper end the bypass 147 has a connector stub for connecting to an external fluid supply, and for explanation of the function of this bypass reference shall be made to FIGS. 17 and 18 and the corresponding description.

An umbilical 130 extends between the surface and the lubricator. This comprises lines 133 for supply of hydraulic fluid and electricity for control of the valves in the Christmas tree and the lubricator (as per standard practice). In addition, lines 133, 134, 135 are arranged for supply of chemical fluids into the lubricator. As mentioned above the chemical fluids may be a diluent, or a hydrate inhibiting fluid, and possibly water. The line 134 communicates with the passage 42 at a position above the upper valve 145, the line 135 communicates with the passage 45 above the lower valve 142 and the line 136 communicates with the passage 45 below the lower valve 142. Stop valves 155, 156 and 157 are located in the respective lines, controlling the supply of the various fluids. In this manner fluids may be supplied to the apparatus at different positions, whereby the desired circulation is achieved.

In addition, check valves may preferably be located in all of the passages discussed above, for increased safeguard against discharges if the connectors or valves should fail.

A container 157 for pressurized gas, preferably nitrogen gas, communicates with the main passage 42 in the LIP-assembly 160 via a supply 158 having a valve 159. This may be used to displace hydrocarbons in the lower part of the LIP-assembly.

The tool assembly (FIG. 2*b*) includes a lower connector device 141' for attachment to the connector 141 of the LIP-assembly, further it may include (mentioned from the bottom and upwardly) a bottom sub 175, the tool housing 162, a valve sub 168 comprising safety valves (cf. 68 and 69 in FIG. 1), an upper sub 179, and a sluice sub 180.

Bypasses 166, 167 are arranged along the side of the lubricator assembly, providing additional fluid passages outside the tool housing The bypasses may be a integrated part of the tool housing but they are preferably pipes being bolted or attached to the outside of the tool housing in another manner, as shown in FIG. 2*a*. The bypass 166 extends between the sluice sub 180 and the connector 141', and communicates with a first passage 164 in the latter. The bypass 167 extends between the valve sub 168 and a second passage 163 in the connector 141'.

The connector piece 141' comprises a main passage 242 communicating axially with the passage 42 in the LIP-assembly, when the connector 141, 141' is assembled. A lateral passage 243 communicates with a passage in the connector piece 141, that in turn communicates with the lower bypass 146 (FIG. 2A). Further, the passage 243 communicates with the passages 163, 164. In addition, the passage 243 also communicates with an inlet 198, whereby a hose or a pipe for external fluid supply may be connected to the passage 243. A stop valve 194, and possibly a pump 193, is located in the inlet 189. Check valves may also be located in the passages.

The bypass 167 communicates with the tool housing 162 on the lower side of the valve sub 168. This permits fluid circulation when the valves 68, 69 have been closed. The bypass comprises a stop valve 171.

The bypass 166 communicates with the tool housing 162 at the sluice sub 180. A stop valve 173 is located in the bypass.

An additional inlet having a valve 174 is located in the vale sub 168 between the valves 68 and 69. The purpose of this inlet is to permit supply of a lubricant into the spacing between the valves for supplementary sealing between the cable/wire and the tool housing. This valve 174 is intended just for use in case of an emergency when the valves 68, 69 have to be closed.

The sluice sub 180 comprises a widened part for receipt of a stuffing box, or a grease injector head. Locking pieces are shown, whereby the stuffing box may be properly locked during operation.

Now, the method of circulating fluids in the lubricator in connection with a well intervention shall be discussed, referring to FIGS. 7-11.

At first, when the intervention shall be performed in a well by means of the lubricator according to the invention, the valves 14 (114; 214) and 16 (116; 216) in the Christmas tree must be closed in order to shut in the well. The cap is removed and the LIP-assembly 40, having the umbilical 30 connected, is lowered from a vessel and connected to the Christmas tree, and the connection is pressure tested.

Figure 7:
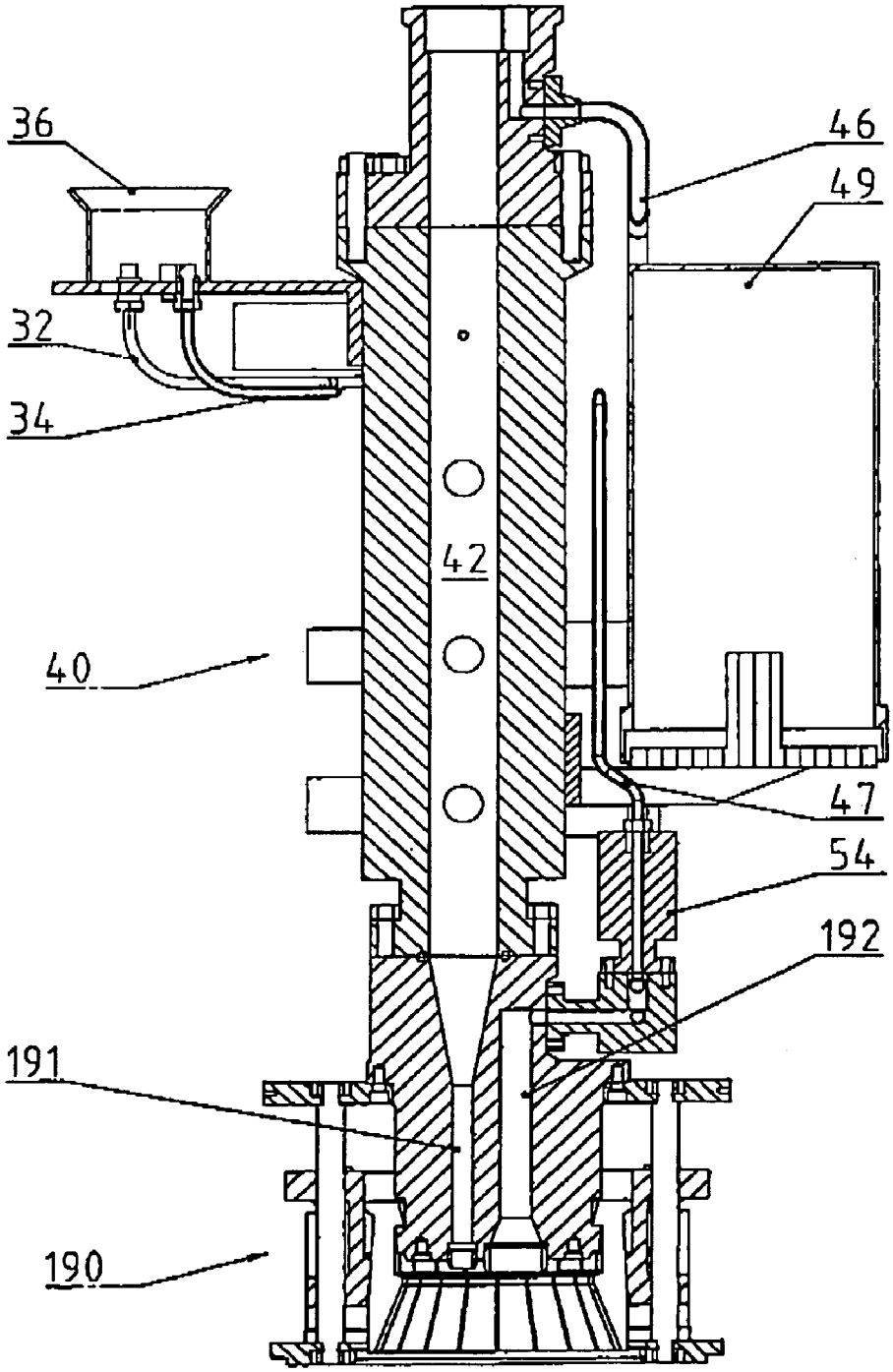
FIG. 7 is a vertical section corresponding to FIG. 6, of a second embodiment of the pressure control assembly.

Now, the tool housing assembly 60 is lowered downwardly and connected to the LIP-assembly 40. Simultaneously, the bypass 66 also is connected to the bypass 46. The connection is pressure tested. The lubricator is at this state filled with sea water. This situation is shown in FIG. 7.

The stuffing box is attached rigidly to the tool housing assembly (the sub 79) in this embodiment. A tool 8, performing downhole works in the well, has been made ready on the vessel and is secured at the end of a wire 7. The tool is lowered downwardly into the lubricator. The stuffing box is opened. A ROV may be present, monitoring and assisting the insertion of the tool into the tool housing assembly.

However, the stuffing box is preferably suspended by the wire 7 before lowering, and lowered with the tool 8, as indicated in FIG. 2B. The tool is inserted in the tool housing 163, and the stuffing box is locked within the sluice sub 180. Then, problems of sealing due to repeated opening and closing of the stuffing box are avoided.

The valves 14, 15 and 45 (or 142, 145) may not be opened for lowering the tool into the well, as this will result in penetration of hydrocarbons into the lubricator and formation of hydrates, due to the fact that the lubricator contains water at this stage. Thus, the percentage of water in the system has to be reduced before the valves may be opened. This is obtained by supplying hydrate inhibiting fluid which will be mixed with water, and which do not form hydrates together with water. Examples of such hydrate inhibiting fluids are methanol, glycol, or a special fluid called MEG (Methyl Ethyl Glycol).

Hereinafter, when referring to methanol, it will be understood that this means any hydrate inhibiting fluid. Supply of methanol is performed until the water content is reduced, whereby risk of formation of hydrates no longer exists.

Figure 8:
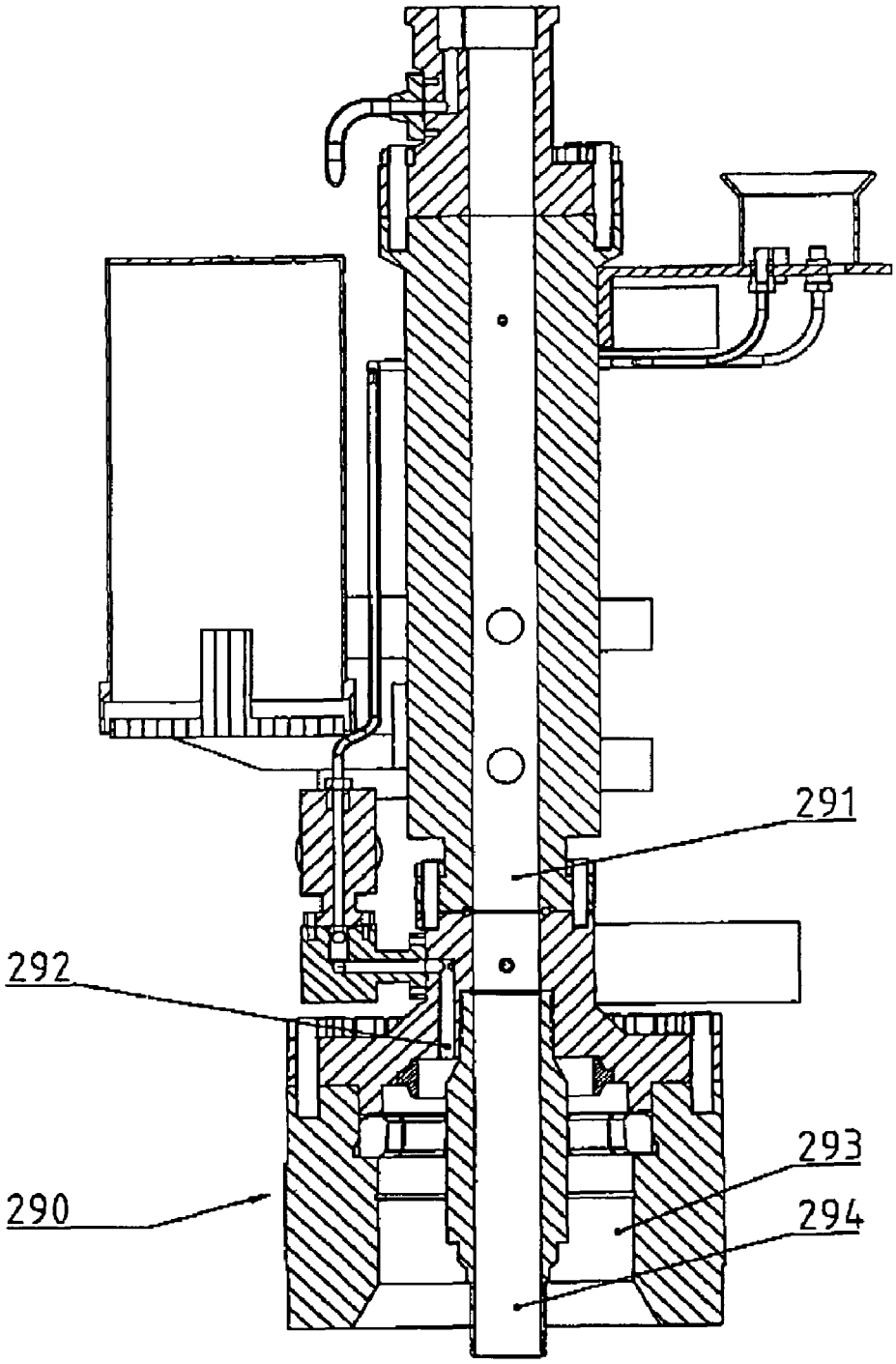
FIG. 8 is a vertical section corresponding to FIG. 6, of a third embodiment of the pressure control assembly.

Now, the valves 14 and 15 in the Christmas tree may be opened (FIG. 8). The valve 33*a* is opened for supply of methanol into the tool housing 63. Thereby, the water will be displaced therefrom and into the bypass 66, 46 and downwardly in the well via the passage 53, alternatively into the flow line 5 (the valves 14 and 16 have been closed and opened, respectively). As the percentage of water in the mixture, in this manner being forced downwardly in the well, still may be so large that this may cause unwanted formation of hydrates in the Christmas tree and the well, the valve 54 is also opened for supply of methanol into the flow in the bypass 46, whereby the water content of the fluids, being supplied into the well, is below the critical limit for formation of hydrates.

In the alternative embodiment according to FIGS. 2*a* and 2*b* the valve 145 is opened and methanol is supplied through the line 135 into the LIP-assembly via the valve 142. The water is displaced into the bypass 166, 146 and downwardly in the well passage 12, alternatively into the pipe line 5. Simultaneously, methanol is supplied through the line 136. Thus, this embodiment provides a better flushing of sea water from the LIP-assembly.

If permitted by environmental reasons, the valve 94 (194) may be opened instead of the valve 57 (152), whereby sea water is flushed into the environment through the outlet 89 (189). Moreover, a possibility for attachment of an external hose exists here, whereby the fluid flushed may be brought to the vessel at the surface for processing.

Now, all of the passages in the tool will contain a mixture of about 50/50 water and methanol. The valve 45 is opened after the pressure has been balanced at both of its sides. Normally, the valves 43 and 44 are open, and will be closed only in a situation of uncontrolled blowout with the tool downwardly in the well, involving that these may cut the wire and stop the well pressure.

During extreme conditions, when the valves 14 and 15 are opened, hydrates may be formed in the adaper, and in the passage 12 above the valve 15. To prevent this, the system may be adjusted, preventing such formation of hydrates. This is accomplished as follows. The valves 45 and 83 are opened. Methanol is supplied through the lines 34, 47 and 53 The water is displaced by methanol from this region. Overpressure may be bled through the pipe 82 (by opening the valve 74). Discharges of polluting methanol from the pipe 82 may be prevented by accurate control of the fluid amount, and the time.

Now, the tool may be run in the well in order to perform work therein.

After the tool has performed its task down in the well, it is withdrawn up into the tool housing. Now, the stuffing box may be opened, whereby the tool may be retrieved to the surface. Now, any other possible tool may be made ready in the same manner as discussed previously in order to perform other tasks in the well.

However, hydrocarbons, particularly gas, have now entered from the well and gathered in the tool housing and, thus, the stuffing box may not be opened, as this will result in discharge of hydrocarbons into the environment. Therefore, when the stuffing box is disconnected and the tool housing again is exposed to the environment, hydrocarbons have to be removed from the tool housing and replaced by water, preventing any risk of pollution.

Figure 14:
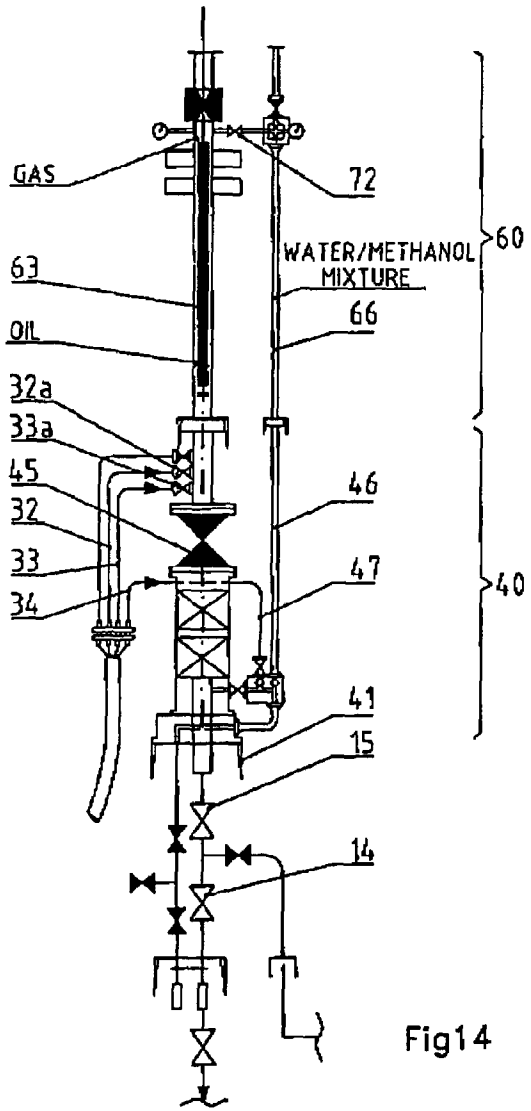

Thus, at this stage the tool housing contains hydrocarbons. The bypass 46, 66 contains a mixture of methanol and water. This situation is shown in FIG. 14. Therefore, before the stuffing box is opened (or retrieved), replacement of the gas and the oil in the tool housing by water (not polluting) is necessary. Previously, this was accomplished by circulating the hydrocarbons via the umbilical to the surface, involving the need for expensive collecting and/or processing equipment at the vessel. This may be done by means of the outlets 89 (189) but the purpose of the invention is that the hydrocarbons shall be circulated back into the well.

At this stage water is pumped through the pipe 32 and into the tool housing 63. As water has a larger density than the gas, the water will displace the gas in the tool housing and over into the bypass. However, in the bypass water flows downwardly and, to ensure that the gas also is forced downwardly in the well, the velocity of the water has to be larger than the rising velocity of the gas.

This may for instance be achieved in the following manner. The tool housing has a diameter of about 7 inches (17,5 cm), while the passage diameter of the bypass 66 is about 1½ inches (3,7 cm). Thus, the flow velocity of the water is increased when it enters the bypass passage, whereby the flow velocity becomes large enough to force the gas downwardly in the well. According to calculations, a flow velocity of 2 m/s in the umbilical will be sufficient to achieve the required flushing velocity in the bypass.

Thus, an important aspect of the invention is providing an effective circulation in the lubricator (large flow velocity in the bypass) with low flow velocity in the umbilical. Low pressure losses are obtained by pumping the liquids having low velocity through the umbilical, something being particularly important over long distances. High flow velocity in the umbilical will cause large friction losses, particularly in long umbilicals.

Figure 15:
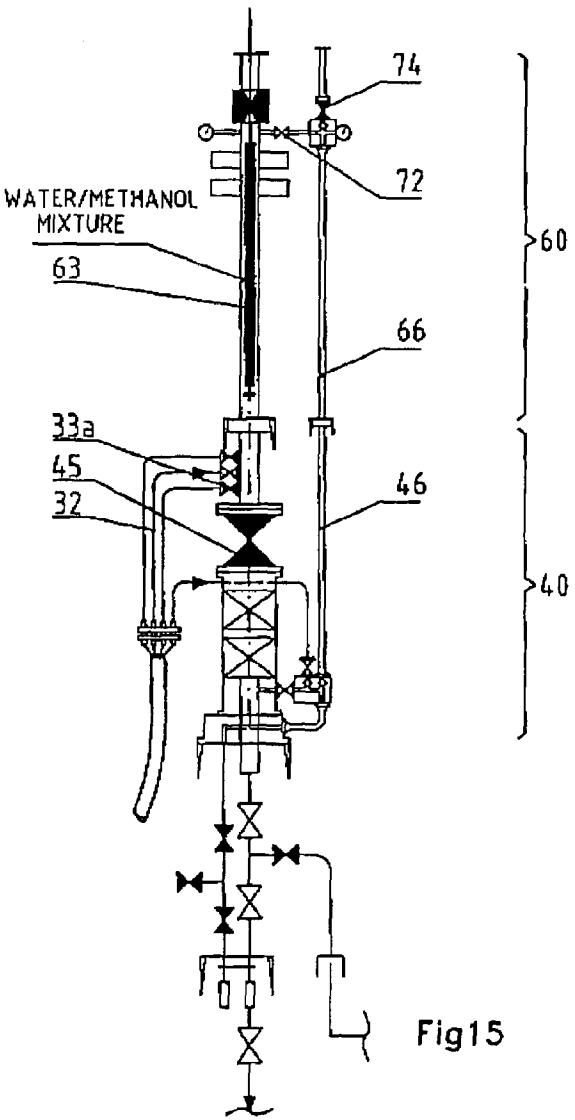

The water being injected contacts the hydrocarbons in the tool housing and may cause formation of hydrates, both in the lubricator and in the well. Therefore, methanol is injected in the water flow to avoid this. At a first stage of the circulating both methanol and water (mixture of about 50/50) are injected into the tool housing, while methanol is supplied via the line 34, 47. At a second stage the valve 33*a*, for supply of methanol into the tool housing, is closed but the methanol injection is maintained into the well. This continues until all of the tool has been filled with water. This situation is shown in FIG. 15.

In some instances hydrocarbons may be present in the lower part of the LIP-assembly, as a sufficient flushing velocity has not been achieved. The valve 159, in the embodiment according to FIG. 2, may be opened in such instances. Then, nitrogen under pressure will flow from the container 157, and force well fluid into the well, respectively into the flow line 5.

Now, the stuffing box may be opened and the tool withdrawn to the surface. If desired, the tool may be replaced by another tool and the whole operation performed once more. If the operation has resulted in increase of pressure in the lubricator, the pressure may be safely bled by opening the valve 74.

If the intervention work has been completed, all of the lubricator may be withdrawn to the surface. At first, the connector 61 is loosened, and the tool housing is withdrawn. Thereafter, the connector 41 is loosened, and the LIP-assembly is withdrawn, along with the adapter.

Figure 16:
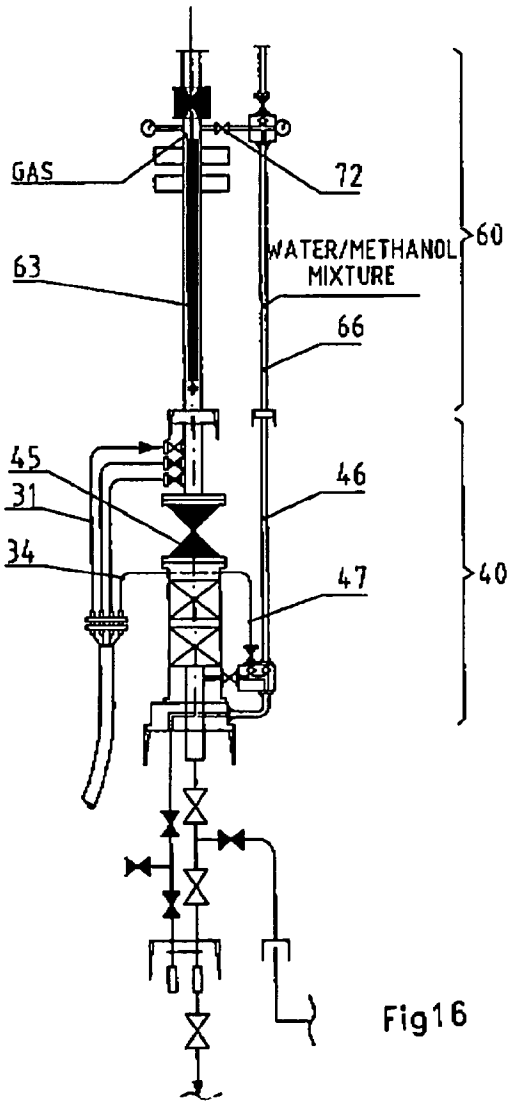

In some cases sticky and semi-liquid oil may gather in the lubricator. If so, this has to be thinned by an appropriate fluid. Hereinafter use of diesel shall be described, as an example, but it will be realized that many diluent fluids are available on the market. Diesel is pumped downwardly through the line 31, and into the tool housing 63, and displaces the oil/gas therein. Water being present in the bypass will be forced downwardly in the well. Therefore, methanol is also injected into the well via the lines 34, 47, preventing formation of hydrates. This situation is shown in FIG. 16.

In order to bring the diesel out of the system at first water and methanol, and thereafter only water are injected into the tool housing, in the same manner as described above. These displace the diesel being forced via the bypass and into the well. Methanol is injected through the line 47.

Figure 17:
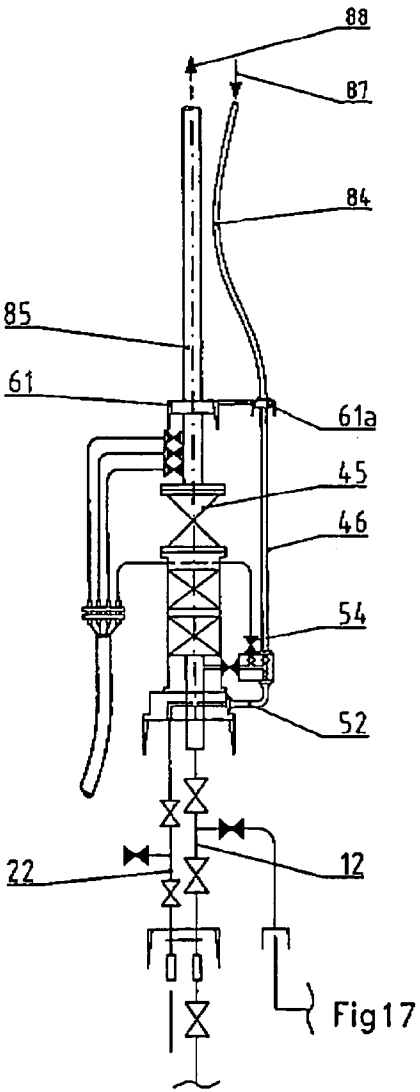
FIGS. 17-18 are diagrammatic sketches showing a second method of circulating.

In a second embodiment the tool is modified, to enable circulating of the well. Such operations are used to supply fluids for chemical treatment into the well (and circulating these out after the treatment has been accomplished). In one alternative the tool housing (and the upper bypass) are disconnected at 61. This situation is shown in FIG. 17. Two supply lines are connected to the LIP-assembly at the connectors 61 and 61*a*. These may be rigid pipes, hoses, or a combination thereof, and having reference numerals 84 and 85. The supply lines end in a termination head having two passages adapted for the connector 61 in a first embodiment (cf. FIG. 3). Alternatively, in a second embodiment the lower sub 75 is maintained. The line 85 is connected at 77 and the pipe 84 is connected to the inlet 89 of the crossover 78.

The valve 45 is opened, while the valve 57 is kept closed. Thereby, fluid may be circulated downwardly through the bypass 46, further through the branch pipe 52 into the lateral passage 22 in the Christmas tree 10, downwardly in the well annulus. The fluid may flow into the tubing 1 via the valve in the tubing and upwardly through the passage 12 in the Christmas tree, and therefrom through the passage 42 in the LIP-assembly and into the vessel through the line 85.

In a second embodiment, shown in FIG. 2, the supply pipe 84 is connected to the bypass 147. The bypass 147 has larger diameter than the bypass 146, whereby a larger flow is obtained therethrough during the circulation.

The direction of circulating may be reversed, i.e. down the passages 42, 12 and up the passages 22, 52, 42.

In a second alternative the tool housing may be situated at the assembly and the line 85 be connected above the stuffing box, while the second line 84 is connected to the cross piece 82. The valve 73 is closed during this operation.

After the circulating has been accomplished the valves in the Christmas tree can be closed and the valve 53 opened. Now, remaining fluid situated in the lubricator may be circulated out before the lines 84, 85 are disconnected.

The invention enables killing of the well by so-called "bullheading", i.e. forcing fluid downwardly in the well against the well pressure. During a situation when control of well has been lost (pressure increase), while the tool is located in the well, the rams 43, 44 have to be closed. In this case restoring control of the well can be difficult. However, according to the invention the bypass provides access into the well. Thereby, special killing fluids may be pumped into the well through the bypass, whereby the well is "killed" and control is restored. Preferably, this operation may be performed by means of the additional bypass, shown in FIG. 2, causing better flow therethrough due to its larger diameter.

In a third embodiment the apparatus may be used to shut down the well by insertion of plugs into the plug profiles in the tubing hanger either in the main passage 19, or in the lateral passage (the annulus passage) 29. During insertion of a plug into the profile an adapter of the kind discussed above (FIG. 3) is used, the passages 42, 62 of the lubricator being in line with the main passage 12 of the Christmas tree. A running tool is used to run, and to locate, or in turn to retrieve the plug. Circulating out fluids is done in the same manner as discussed previously.

However, when inserting a plug into the profile 29 the main passage 42 has to be brought into axial extension with the annulus passage 22 of the Christmas tree. Another adapter 190 is connected to the LIP-assembly, as shown in FIG. 6. This is designed such that, during attachment of the lubricator to the Christmas tree, the passage 42 of the LIP-assembly extends axially in the extension of the passage in the adapter, which in turn is in connection with the annulus passage 22 in the Christmas tree. Now, as also indicated in FIG. 14, the production passage 12 of the Christmas tree will have fluid communication with the bypass 46 via the passage 192 in the adapter. Thereby, circulation may also be maintained during such operations.

A running tool is run downwardly and inserted into the tool housing in the same manner as discussed previously Fluids (i.e. water) are circulated into the well, correspondingly as when the tool is completed for ordinary use, as discussed previously. This situation is shown in FIG. 15.

The valves 24, 25 are opened and the tool run downwardly with the annulus plug for insertion of this. At this stage, both the tool housing and the bypass pipe contain a mixture of methanol and water (usually 50/50). The valves 14, 15 in the Christmas tree are closed, while the valves 24, 25 in the lateral passage are open. The downhole safety valve 2 is also closed This situation is shown in FIG. 16

After the plug has been locked in place, the tool 8 is withdrawn upwardly in the tool housing and the valves 24, 25 in the Christmas tree are closed. After this stage, the tool housing will also contain oil and gas which must be removed before the running tool is disconnected. This is accomplished in the same manner as discussed previously. This situation is shown in FIG. 17.

When the tool housing has been filled with water, all the valves can be closed and the stuffing box may be withdrawn to the surface together with the tool, or the stuffing box can be opened and the tool withdrawn therethrough. Overpressure in the lubricator may be bled by opening the valve 83, as discussed above.

When performing the reversed operation, i.e. when a plug in the Christmas tree is to be withdrawn, the same method of circulating is applied.

In the embodiment discussed above the apparatus being used for well intervention is shown used with a vertical (conventional) Christmas tree. Hereinafter it shall be discussed how the apparatus may be used with horizontal Christmas trees, referring to FIGS. 18 and 19.

Figure 18:
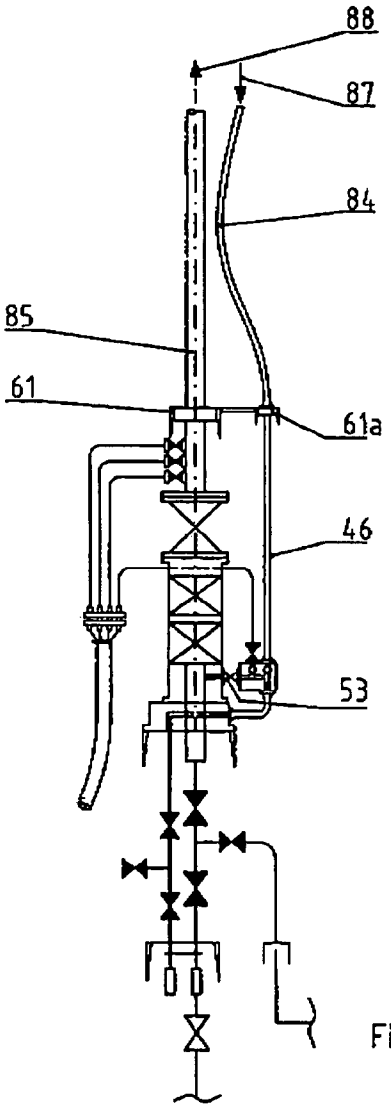
Figure 20:
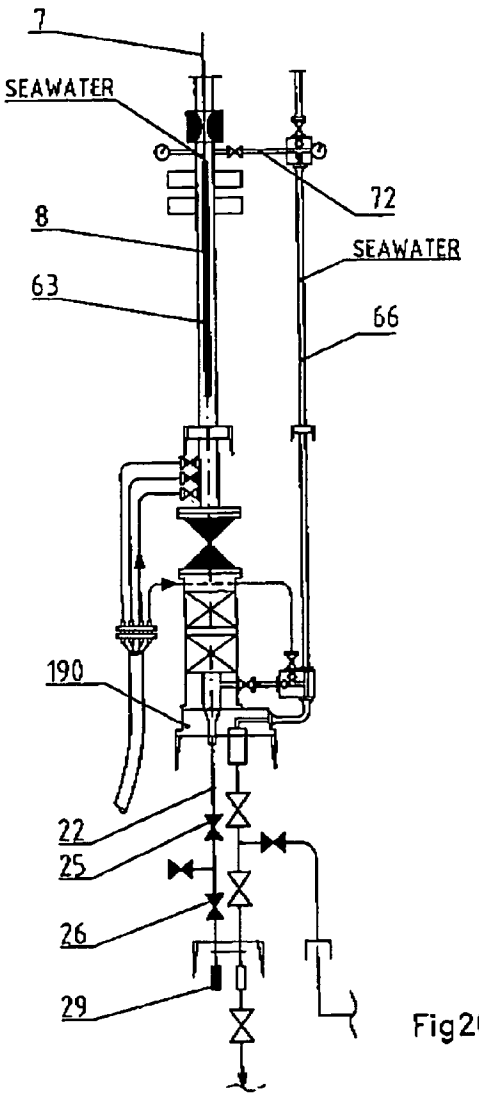

In FIG. 18 the Christmas tree comprises a ball valve. This must be opened to achieve access into the Christmas tree. As this is another kind of Christmas tree, another adapter 290 is used, as shown in FIG. 20. This adapter comprises a valve actuator (not shown), for opening the ball valve 115 when the LIP-assembly has been connected to the Christmas tree Also as shown in FIG. 20 the adapter comprises a passage 294 providing the axial extension of the passage 12 up to the passage 42 A second passage 292 provides fluid communication between the bypass 46 and the annulus 293 in the Christmas tree.

A pulling tool 8 for plugs is connected to the wire 7 and the stuffing box 64 is opened, whereby the tool may be inserted into the tool housing 63, as discussed previously. Now, as in embodiments described previously, the tool housing contains water having to be removed, or thinned before use. However, in such Christmas trees direct access into the well is not available until the plug 118 has been removed. Thus, pumping of fluids downwardly in the well (or in the tubing) is impossible.

Figure 21:
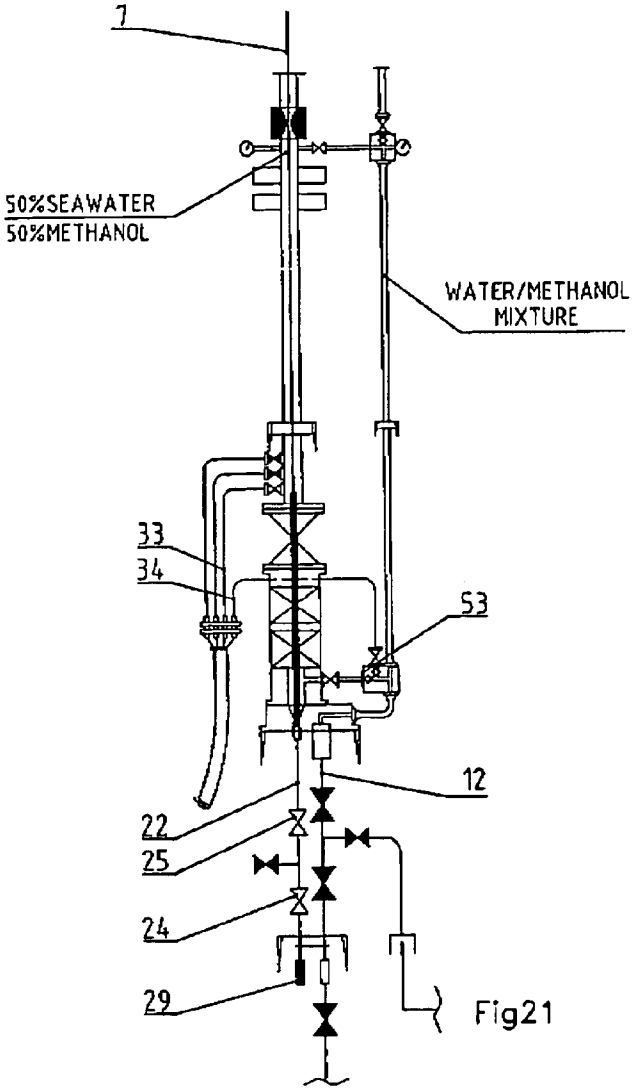

However, this circulation may be achieved by means of the bypass and the adapter according to the invention. The workover valve 131 is opened. Now, there are several alternatives. The preferred embodiment is to open the valve 132. Fluid is pumped down into the well, or into the flow line 5, if the valve 116 is opened. This situation is shown in FIG. 21.

If the annulus master valve 124 is opened, fluid may be pumped down into the well annulus. However, this may be difficult (undesirable pressure increase) and is not preferred.

Figure 22:
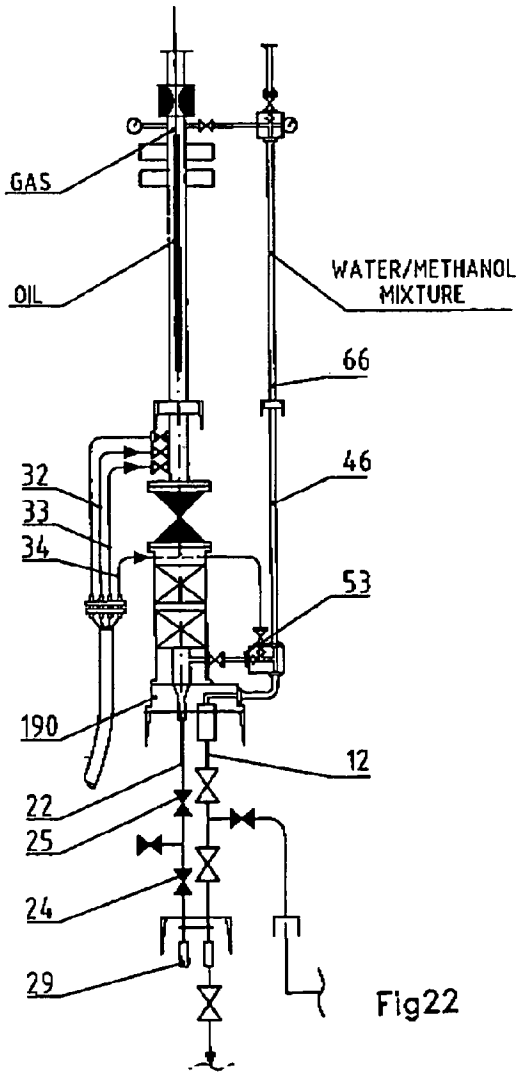
Figure 25:
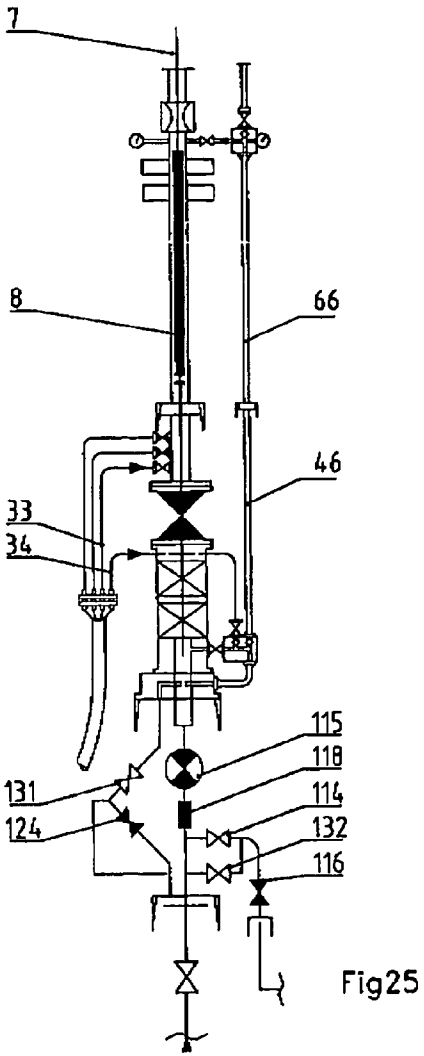
FIGS. 25-26 are diagrammatic sketches of the method of circulating out, for a horizontal Christmas tree as shown in FIG. 24.

The valve 45 can be opened and the tool can withdraw the plug 118. The valves 131 and 132 are closed. Hydrocarbons in the tool housing is circulated into the well, as discussed previously in connection with a conventional Christmas tree. This is shown in FIG. 22.

Figure 19:
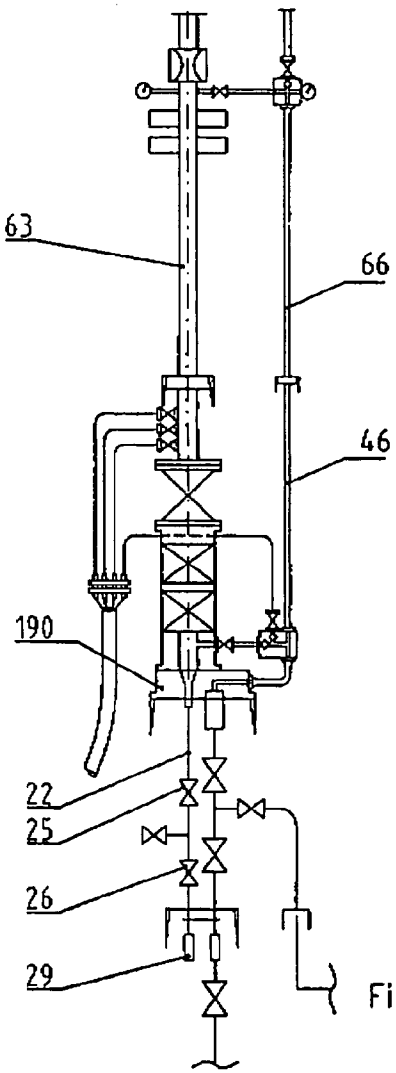
FIGS. 19-22 are diagrammatic sketches showing a third method of circulating.

When the Christmas tree as in FIG. 19 includes two bridge plugs, the method described above must be performed twice. First, water has to be removed by circulating the water through the workover valve, as discussed. After withdrawal of the first plug, access into the well is not available. The lubricator may also contain hydrocarbons. Removal of the hydrocarbons is accomplished in the same manner as discussed in connection with the conventional Christmas tree, apart from the hydrocarbons being circulated through the crossover, into the well or into the flow line.

When all the barriers have been removed, the procedures of running and circulating are similar to those being discussed above regarding a conventional Christmas tree.

Many other alternatives are possible within the scope of the invention. As an example, during circulating fluids (hydrocarbons or water) in the system instead of forcing these backwardly in the well, the master valve 14 may be closed and the wing valve 16 be opened, whereby the displaced fluid is forced into the flow line. This may be desirable, for instance if the pressure in the well is at a level making it difficult to force the fluids into the well. As the pressure in the flow line may be controlled from the production vessel, an underpressure facilitating the circulating of fluids in the pipe line may for instance be provided.

In an alternative, when discharge of methanol into the sea is allowed, circulating the hydrocarbons along with water will be unnecessary. As shown in FIG. 2, after work in the well, the valve 142 may be closed and methanol be supplied through the line 135, whereby the hydrocarbons will be flushed into the well. Then, the stuffing box may be opened, as escape of some methanol into the environment is no problem.

The invention claimed is:

1. A subsea lubricator for attachment to a subsea Christmas tree comprising at least one tree passage therethrough, said subsea lubricator comprising:

a pressure control assembly;

a tool housing assembly adapted to be positioned above said pressure control assembly, said tool housing assembly comprising at least one lubricator passage that is adapted to receive a tool therein, said tool being operatively coupled to a wire, a cable or a line used in lowering said tool into said tool housing assembly;

a sealing assembly adapted to be positioned above said tool housing assembly, said sealing assembly adapted to slidingly seal around said wire, cable or line; and at least one bypass assembly comprising at least one bypass passage that is in fluid communication with said at least one lubricator passage and at least one tree passage in said subsea Christmas tree.

2. The subsea lubricator of claim 1, wherein said at least one bypass assembly further comprises at least one lower bypass pipe and at least one upper bypass pipe removably connected to said at least one lower bypass pipe.

3. The subsea lubricator of claim 2, wherein said at least one bypass assembly comprises at least two upper bypass pipes.

4. The subsea lubricator of claim 2, wherein said tool housing assembly comprises a tool housing portion comprising an upper end and a bore which defines a portion of said at least one lubricator passage, said bypass assembly further comprising a crossover assembly for fluidly connecting said at least one upper bypass pipe with said at least one lubricator passage at a location proximate to said upper end of said tool housing portion.

5. The subsea lubricator of claim 4, wherein said pressure control assembly comprises a lower end, a bore which defines a portion of said at least one lubricator passage, and at least one pressure control valve for selectively closing said at least one lubricator passage, said bypass assembly further comprising a valve assembly for fluidly connecting said at least one lower bypass pipe with said at least one lubricator passage at a location below said at least one pressure control valve.

6. The subsea lubricator of claim 4, wherein said crossover assembly further comprises a connector for fluidly connecting said crossover assembly to an external fluid source.

7. The subsea lubricator of claim 5, wherein said subsea Christmas tree further comprises a production passage and an annulus passage, said valve assembly further comprising a first inlet fluidly connected to said at least one lower bypass pipe, a second inlet fluidly connected to a subsea umbilical, a first outlet fluidly connected to said production passage in said subsea Christmas tree, and a second outlet fluidly connected to said annulus passage in said subsea Christmas tree.

8. The subsea lubricator of claim 7, wherein said valve assembly further comprises at least one check valve disposed in each of said first and second inlets.

9. The subsea lubricator of claim 7, wherein said valve assembly further comprises at least one stop valve disposed in said first outlet.

10. The subsea lubricator of claim 7, wherein said valve assembly further comprises at least one stop valve disposed in said second outlet.

11. The subsea lubricator of claim 5, further comprising an adaptor, said valve assembly forming a portion of said adaptor.

12. The subsea lubricator of claim 11, wherein said adaptor is removably attached to said pressure control assembly, said adaptor comprising a subsea connector adapted for connecting to said subsea Christmas tree.

13. The subsea lubricator of claim 11, wherein said subsea Christmas tree further comprises a production passage and an annulus passage, said adaptor further comprising a first adaptor passage for fluidly connecting said at least one lubricator passage with said production passage in said subsea Christmas tree, and a second adaptor passage for fluidly connecting said at least one lower bypass pipe with said annulus passage in said subsea Christmas tree.

14. The subsea lubricator of claim 11, wherein said subsea Christmas tree further comprises a production passage and an annulus passage, said adaptor further comprising a first adaptor passage for fluidly connecting said at least one lubricator passage with said annulus passage in said subsea Christmas tree, with a second adaptor passage for fluidly connecting said at least one lower bypass pipe with said production passage in said subsea Christmas tree.

15. The subsea lubricator of claim 11, further comprising a valve actuator.

16. A method for circulating fluid in a subsea lubricator attached to a subsea Christmas tree landed on a subsea well, said subsea lubricator comprising a tool housing assembly adapted to receive a tool therein, said tool being operatively coupled to a wire, a cable or a line used in lowering said tool into said tool housing, and a sealing assembly adapted to be positioned above said tool housing assembly, said sealing assembly adapted to slidingly seal around said wire, cable or line, said method comprising:

providing at least one bypass passage fluidly connecting said subsea lubricator to said subsea Christmas tree;

connecting said subsea lubricator to a source of a first external fluid;

injecting said first external fluid into said subsea lubricator to displace a first internal fluid within said subsea lubricator; and circulating said first internal fluid through said bypass passage and said subsea Christmas tree to said subsea well or into an external flow line.

17. The method of claim 16, wherein said first external fluid comprises water.

18. The method of claim 16, wherein said first external fluid comprises a hydrate inhibiting fluid.

19. The method of claim 18, wherein said hydrate inhibitor is selected from the group consisting of methanol and glycol.

20. The method of claim 16, wherein said first external fluid is a diluent fluid.

21. The method of claim 16, wherein said first internal fluid comprises water, said method further comprising injecting a hydrate inhibiting fluid into said subsea well concurrently with circulating said first internal fluid.

22. The method of claim 16, wherein said first internal fluid comprises hydrocarbons and said first external fluid comprises a mixture of water and a hydrate inhibiting fluid, said method further comprising:

connecting said subsea lubricator to a source of a second external fluid after circulating said first internal fluid, said second external fluid comprising water;

injecting said second external fluid into said subsea lubricator to displace a second internal fluid, said second internal fluid comprising the mixture of water and hydrate inhibiting fluid, the hydrate inhibiting fluid comprising said first external fluid;

circulating said second internal fluid through said bypass passage and said subsea Christmas tree to said subsea well or into said external flow line; and injecting a hydrate inhibiting fluid into said subsea well concurrently with circulating said second internal fluid.

23. A method for killing a subsea well having a subsea Christmas tree landed thereon, said method comprising:

landing a subsea lubricator on said subsea Christmas tree, said subsea lubricator comprising a tool housing assembly adapted to receive a tool therein, said tool being operatively coupled to a wire, a cable or a line used in lowering said tool into said tool housing, and a sealing assembly adapted to be positioned above said tool housing assembly, said sealing assembly adapted to slidingly seal around said wire, cable or line and at least one valve;

providing at least one bypass passage fluidly connecting said subsea Christmas tree with a source of kill fluid; and when said at least one valve is closed, injecting said kill fluid into said well through said bypass passage and said subsea Christmas tree.

24. A method of circulating fluids in a subsea well having a subsea Christmas tree landed thereon, said method comprising:

providing a production passage and an annulus passage in said subsea Christmas tree;

providing a tubing string below said subsea Christmas tree in fluid communication with said production passage;

providing a tubing annulus below said subsea Christmas tree in fluid in communication with said annulus passage;

providing a downhole fluid connection between said tubing string and said tubing annulus;

providing a pressure control assembly having a first passage therethrough and a lower bypass pipe;

landing said pressure control assembly on said subsea Christmas tree such that said first passage is fluidly connected to said production passage and said lower bypass pipe is fluidly connected to said annulus passage;

landing a tool housing assembly on said pressure control assembly, said tool housing assembly adapted to receive a tool therein, said tool being operatively coupled to a wire, a cable or a line used in lowering said tool into said tool housing, and a sealing assembly adapted to be positioned above said tool housing assembly, said sealing assembly adapted to slidingly seal around said wire, cable or line;

removing said tool housing assembly from said pressure control assembly;

connecting a first supply pipe to said first passage;

connecting a second supply pipe to said lower bypass passage; and circulating fluid from said second supply pipe, through said lower bypass pipe, through said annulus passage, down into the well through said tubing annulus, through said downhole fluid connection, up through said tubing string, through said production passage, through said first passage in said pressure control assembly, and into said first supply pipe.

25. A method for circulating fluids in a subsea well having a subsea Christmas tree landed thereon, said method comprising the steps of:

providing a production passage and an annulus passage in said subsea Christmas tree;

providing a tubing string below said subsea Christmas tree in fluid communication with said production passage;

providing a tubing annulus below said subsea Christmas tree in fluid communication with said annulus passage;

providing a downhole fluid connection between said tubing string and said tubing annulus;

providing a pressure control assembly having a first passage therethrough and a lower bypass pipe;

landing said pressure control assembly on said subsea Christmas tree such that said first passage is fluidly connected to said production passage and said lower bypass pipe is fluidly connected to said annulus passage;

connecting a first supply pipe to said first passage;

connecting a second supply pipe to said lower bypass pipe; and circulating fluid from said first supply pipe, through said first passage in said pressure control assembly, through said production passage, down into the well through said tubing string, through said downhole fluid connection, up through said tubing annulus, through said annulus passage, through said lower bypass pipe, and into said second supply pipe.

26. A subsea lubricator for attachment to a subsea Christmas tree comprising at least one tree passage therethrough, said subsea lubricator comprising:

at least one lubricator passage which communicates with at least one tree passage in said subsea Christmas tree;

at least one bypass assembly comprising at least one bypass passage which communicates with at least one passage in said subsea Christmas tree, the at least one bypass comprising at least one lower and at least one upper bypass pipe removably connected to each other;

a tool housing assembly comprising an upper end and a bore which defines a portion of said at least one lubricator passage, said tool housing assembly being adapted to receive a tool therein, said tool being operatively coupled to a wire, a cable or a line;

a sealing assembly adapted to be positioned above said tool housing assembly, said sealing assembly adapted to slidingly seal around said wire, cable or line; and a fluid connection between the at least one upper bypass pipe and the lubricator passage at an upper end of the tool housing assembly, the fluid connection comprising a crossover having a connector for attachment of an external fluid supply source.

27. A subsea lubricator for attachment to a subsea Christmas tree comprising at least one tree passage therethrough, said subsea lubricator comprising:

at least one lubricator passage which communicates with at least one tree passage in said subsea Christmas tree;

at least one bypass assembly comprising at least one bypass passage which communicates with at least one tree passage in said subsea Christmas tree, the at least one bypass comprising at least one lower and at least one upper bypass pipe removably connected to each other;

a tool housing portion comprising an upper end and a bore which defines a portion of said at least one lubricator passage, said tool housing portion being adapted to receive a tool therein, said tool being operatively coupled to a wire, a cable or a line;

a sealing assembly adapted to be positioned above said tool housing portion, said sealing assembly adapted to slidingly seal around said wire, cable or line;

a fluid connection between the at least one upper bypass pipe and the lubricator passage at an upper end of the tool housing;

a pressure control assembly coupled between the tool housing portion and said subsea Christmas tree; and a valve assembly providing fluid connection between the at least one lower bypass pipe and a passage of the pressure control assembly at a position below at least one valve of the pressure control assembly, the valve assembly comprising a first inlet connected to at least one lower bypass pipe, a second inlet connected to an umbilical, a first outlet connected to a production passage of the Christmas tree, and a second outlet connected to an annulus passage of the Christmas tree.

28. A subsea lubricator for attachment to a subsea Christmas tree comprising at least one tree passage therethrough, said subsea lubricator comprising:

at least one lubricator passage which communicates with at least one tree passage in said subsea Christmas tree;

at least one bypass assembly comprising at least one bypass passage which communicates with at least one tree passage in said subsea Christmas tree, the at least one bypass comprising at least one lower and at least one upper bypass pipe removably connected to each other;

a tool housing portion comprising an upper end and a bore which defines a portion of said at least one lubricator passage, said tool housing portion being adapted to receive a tool therein, said tool being operatively coupled to a wire, a cable or a line;

a sealing assembly adapted to be positioned above said tool housing portion, said sealing assembly adapted to slidingly seal around said wire, cable or line;

a fluid connection between the at least one upper bypass pipe and the lubricator passage at an upper end of the tool housing;

a pressure control assembly coupled between the tool housing portion and said subsea Christmas tree;

a valve assembly providing fluid connection between the at least one lower bypass pipe and a passage of the pressure control assembly at a position below at least one valve of the pressure control assembly, the valve assembly comprising a first inlet connected to at least one lower bypass pipe, a second inlet connected to an umbilical, a first outlet connected to a production passage of the Christmas tree, and a second outlet connected to an annulus passage of the Christmas tree; and an adaptor removably attachable to the pressure control assembly comprising a connector device which is adapted to connector profiles for various Christmas trees.

29. A riserless subsea lubricator that is adapted to be attached above a subsea Christmas tree positioned above a subsea well, the riserless subsea lubricator comprising:

a tool housing of said riserless subsea lubricator said tool housing adapted to be positioned above said Christmas tree, said tool housing being adapted to receive a tool positioned therein;

a sealing assembly that is adapted to be positioned above said tool housing, said sealing assembly adapted to slidingly seal around a wire, cable or line that is used in lowering said tool into said tool housing; and at least one bypass line for circulating fluid from said tool housing to said subsea well or to an external flow line.

30. The subsea lubricator of claim 29, wherein said tool housing comprises a single passageway that is adapted to receive said tool.

31. The subsea lubricator of claim 29, wherein said tool housing comprises a tubular column that is adapted to receive said tool.

32. The subsea lubricator of claim 29, further comprising a pressure control assembly that is adapted to be positioned between said tool housing and said Christmas tree.

33. The subsea lubricator of claim 29, wherein said sealing assembly comprises a grease injector head.

34. The subsea lubricator of claim 29, wherein said sealing assembly comprises a stuffing box.

35. The subsea lubricator of claim 29, wherein said at least one bypass line provides fluid communication between said tool housing and said Christmas tree for circulating fluid from said tool housing to said subsea well.

36. The subsea lubricator of claim 29, wherein said at least one bypass line is positioned external of said Christmas tree and said tool housing.

37. The subsea lubricator of claim 1, wherein said subsea lubricator is a riserless subsea lubricator.

38. The subsea lubricator of claim 26, wherein said subsea lubricator is a riserless subsea lubricator.

39. The subsea lubricator of claim 27, wherein said subsea lubricator is a riserless subsea lubricator.

40. The subsea lubricator of claim 28, wherein said subsea lubricator is a riserless subsea lubricator.

* * * * *